US010807086B2

(12) United States Patent
Motadel

(10) Patent No.: US 10,807,086 B2
(45) Date of Patent: Oct. 20, 2020

(54) PIPETTING SYSTEM DEVICE

(71) Applicant: BIOTIX, INC., San Diego, CA (US)

(72) Inventor: Arta Motadel, San Diego, CA (US)

(73) Assignee: BIOTIX, INC., San Diego, CA (US)

( * ) Notice: Subject to any disclaimer, the term of this patent is extended or adjusted under 35 U.S.C. 154(b) by 0 days.

(21) Appl. No.: 15/465,281

(22) Filed: Mar. 21, 2017

(65) Prior Publication Data

US 2017/0197209 A1 Jul. 13, 2017

Related U.S. Application Data

(63) Continuation of application No. 14/439,991, filed as application No. PCT/US2013/068150 on Nov. 1, 2013.

(60) Provisional application No. 61/722,043, filed on Nov. 2, 2012.

(51) Int. Cl.
*B01L 3/02* (2006.01)

(52) U.S. Cl.
CPC ..... *B01L 3/0275* (2013.01); *B01L 3/0279* (2013.01); *B01L 2200/023* (2013.01); *B01L 2200/04* (2013.01); *B01L 2200/0689* (2013.01); *B01L 2300/0829* (2013.01)

(58) Field of Classification Search
CPC ..... B01L 3/0275; B01L 2200/023; F16L 33/227; F16L 33/30
See application file for complete search history.

(56) References Cited

U.S. PATENT DOCUMENTS

| | | | | |
|---|---|---|---|---|
| 5,580,529 | A | 12/1996 | Devaughn et al. | |
| 8,512,650 | B2 * | 8/2013 | Jungheim | B01L 3/0275 422/524 |
| 8,898,876 | B2 | 12/2014 | Feith et al. | |
| 2004/0231438 | A1 | 11/2004 | Schwartz | |
| 2005/0089450 | A1 | 4/2005 | Al-Mahareeq et al. | |
| 2006/0110296 | A1 * | 5/2006 | Tajima | G01N 35/025 422/400 |
| 2007/0003445 | A1 | 1/2007 | Belgardt et al. | |
| 2007/0180935 | A1 | 8/2007 | Angus et al. | |
| 2007/0241119 | A1 | 10/2007 | Durkin et al. | |
| 2007/0297948 | A1 | 12/2007 | May et al. | |

FOREIGN PATENT DOCUMENTS

| | | |
|---|---|---|
| EP | 1 319 437 | 6/2003 |
| EP | 1 862 219 | 12/2007 |
| FR | 2 882 273 | 8/2006 |
| GB | 1185220 A | 3/1970 |
| WO | WO 2010/082080 | 7/2010 |
| WO | WO 2014/071243 | 5/2014 |

OTHER PUBLICATIONS

Supplementary European Search Report dated May 31, 2016 in European Patent Application No. EP 13851340.3, filed on Nov. 1, 2013 and published as EP 2 914 380 dated Sep. 9, 2015.

(Continued)

*Primary Examiner* — Justin N Olamit
(74) *Attorney, Agent, or Firm* — Grant IP, Inc.

(57) ABSTRACT

Disclosed here are pipetting system devices useful for acquiring or dispelling liquids from an automated fluid dispensing device.

18 Claims, 36 Drawing Sheets

(56) References Cited

OTHER PUBLICATIONS

International Search Report and Written Opinion dated Feb. 10, 2014 in International Application No. PCT/US2013/068150, filed on Nov. 1, 2013 and published as WO 2014/071243 dated May 8, 2014.
International Preliminary Report on Patentability dated May 14, 2015 in International Application No. PCT/US2013/068150, filed on Nov. 1, 2013 and published as WO 2014/071243 dated May 8, 2014.
Non Final Office Action dated Aug. 19, 2016 in U.S. Appl. No. 14/439,991, filed Apr. 30, 2015 and published as US 2015-0273463 dated Oct. 1, 2015.
Final Office Action dated Dec. 21, 2016 in U.S. Appl. No. 14/439,991, filed Apr. 30, 2015 and published as US 2015-0273463 dated Oct. 1, 2015.
"Extended European Search Report dated Nov. 19, 2019 in Europe Patent Application No. 19198586.8, filed on Nov. 1, 2013", 08 pages.

* cited by examiner

PIPETTING SYSTEM DEVICE

RELATED PATENT APPLICATIONS

This patent application is a continuation of U.S. patent application Ser. No. 14/439,991 filed on Apr. 30, 2015, entitled PIPETTING SYSTEM DEVICE, naming Arta Motadel as an inventor, which is a 35 U.S.C. 371 national stage application of international patent application no. PCT/US2013/068150, filed on Nov. 1, 2013, entitled PIPETTING SYSTEM DEVICE, naming Arta Motadel as an inventor, which claims the benefit of U.S. provisional application No. 61/722,043, filed Nov. 2, 2012, entitled PIPETTING SYSTEM DEVICE, naming Arta Motadel as inventor. The entirety of each of the foregoing patent applications is incorporated herein by reference.

FIELD

The technology in part relates to an automated pipetting system and pipetting system devices that, in some embodiments, reversibly attach to components or parts of an automated pipetting system.

BACKGROUND

Automated multichannel pipette systems often are used for laboratory research, especially in the biotechnology and medical fields, for simultaneously transferring a plurality of liquid samples between multi-welled trays. Such systems include multiple pipettors having one or more pumping devices to draw in and expel precise volumes of a liquid. Automated multichannel pipette systems typically include an upper housing (e.g., a pipette head) comprising an array of nozzles each configured to receive a single size of pipette tip. The upper housing of such a device is also typically equipped with a movable plate that is configured to eject pipette tips after use. Automated multichannel pipettors are commercially available that can simultaneously dispense samples or reagents into multi-welled plates, typically 96 or 384 wells, at the same time from a corresponding number of channels or syringes.

SUMMARY

Provided herein, in certain aspects, is a nozzle capable of reversibly associating with a pipette tip chosen from pipette tips having sealing zones of substantially different diameters, and which nozzle is capable of connecting to a fluid delivery actuator component, the nozzle comprising a substantially tubular exterior surface, a proximal terminus, a distal terminus, an interior bore terminating at each of the proximal terminus and the distal terminus, a distal region and a proximal region, which proximal region comprises a connector configured to sealingly connect the nozzle to a head of a fluid delivery actuator component, which distal region comprises a first pipette tip association member and a second pipette tip association member adjacent to, and distal to, the first pipette tip association member, which first pipette tip association member comprises a body, which body comprises an exterior surface and a first mean circumference, and a first annular pipette tip sealing zone protruding from the exterior surface of the body, which second pipette tip association member comprises a body, which body comprises an exterior surface and a second mean circumference, and a second annular pipette tip sealing zone protruding from the exterior surface of the body and which first mean circumference is greater than the second mean circumference.

Also provided herein, in some aspects, is a head component capable of being fitted to a fluid delivery device, which head component comprises two opposing surfaces, sides between the opposing surfaces and a plurality of nozzles projecting from one of the opposing surfaces, each of which nozzles is capable of reversibly associating with a pipette tip chosen from pipette tips having sealing zones of substantially different diameters, and each of which nozzles comprises, a substantially tubular exterior surface, a proximal terminus, a distal terminus, an interior bore terminating at each of the proximal terminus and the distal terminus, a distal region and a proximal region, which distal region comprises a first pipette tip association member and a second pipette tip association member adjacent to, and distal to, the first pipette tip association surface, which first pipette tip association member comprises a body, which body comprises an exterior surface and a first mean circumference, and a first annular pipette tip sealing zone protruding from a surface of the body, which second pipette tip association member comprises a body, which body comprises an exterior surface and a second mean circumference, and a second annular pipette tip sealing zone protruding from a surface of the body and which first mean circumference is greater than the second mean circumference.

Also provided herein, in certain aspects, is an ejection plate capable of ejecting pipette tips from nozzles of a fluid delivery device having ejection rods, which ejection plate comprises, a plate member comprising two opposing plate member surfaces, an array of bores, each of the bores terminating at each of the opposing plate member surfaces, risers extending from one of the plate member surfaces, a flange extending from each of the risers, which flange comprises two opposing flange surfaces substantially parallel to the plate member surfaces and a connector in association with a flange surface, which connector is configured to effectively connect the ejection plate to an ejection rod of a fluid delivery device or which connector is configured to effectively connect the ejection plate to another ejection plate attached to a fluid delivery device.

Also provided herein, in some aspects, is an ejection plate capable of ejecting pipette tips from nozzles of a fluid delivery device having ejection rods, which ejection plate comprises a plate member comprising two opposing plate member surfaces, an array of bores terminating at each of the opposing plate member surfaces, the surface of each of which bores is not a vertical surface extending from one plate member surface to the other plate member surface and connectors each in association with a surface of the ejection plate, each of which connectors is configured to effectively connect the ejection plate to an ejection rod of a fluid delivery device or each of which connectors is configured to effectively connect the ejection plate to another ejection plate attached to a fluid delivery device. In some embodiments each of the connectors in association with the ejection plate is configured for a magnetic connection.

Also provided herein, in certain aspects, is a composition comprising a second ejection plate and a first ejection plate each capable of ejecting pipette tips from nozzles of a fluid delivery device having ejection rods, which second ejection plate and which first ejection plate each comprise, a plate member comprising two opposing plate member surfaces, an array of bores, each of which bores terminates at each of the opposing plate member surfaces and connectors each in association with a surface of each of the second ejection plate and the first ejection plate, wherein the connectors of the second ejection plate and the connectors of the first ejection plate are configured for mounting the second ejection plate and the first ejection plate in a fluid delivery device whereby the plate member surfaces of the second ejection plate are distal to the plate member surfaces of the first ejection plate, mounting the second ejection plate and the first ejection plate in an orientation that positions the bores of the second ejection plate concentric with the bores of the first ejection plate. In some embodiments the connectors are configured for a magnetic connection.

Also provided herein, in some aspects, is a method for ejecting one or more pipette tips from an automated fluid delivery device comprising sealingly connecting pipette tips to nozzles of a head component of a fluid delivery device which nozzles are substantially the same and each of which nozzles is capable of reversibly associating with a pipette tip, which one or more pipette tips are chosen from pipette tips having sealing zones of substantially different diameters, and ejecting the pipette tips from the nozzles via actuation of an ejector effectively magnetically attached to the fluid delivery device, which ejector plate contacts the pipette tips and displaces the pipette tips from the nozzle. In some embodiments the method also comprises attaching the ejector plate to the head component of a fluid delivery device, wherein the ejector plated is magnetically mounted to the head component.

Certain embodiments are described further in the following description, claims and drawings.

BRIEF DESCRIPTION OF THE DRAWINGS

The drawings illustrate embodiments of the technology and are not limiting. For clarity and ease of illustration, the drawings are not made to scale and, in some instances, various aspects may be shown exaggerated or enlarged to facilitate an understanding of particular embodiments.

DETAILED DESCRIPTION

Figure 1:
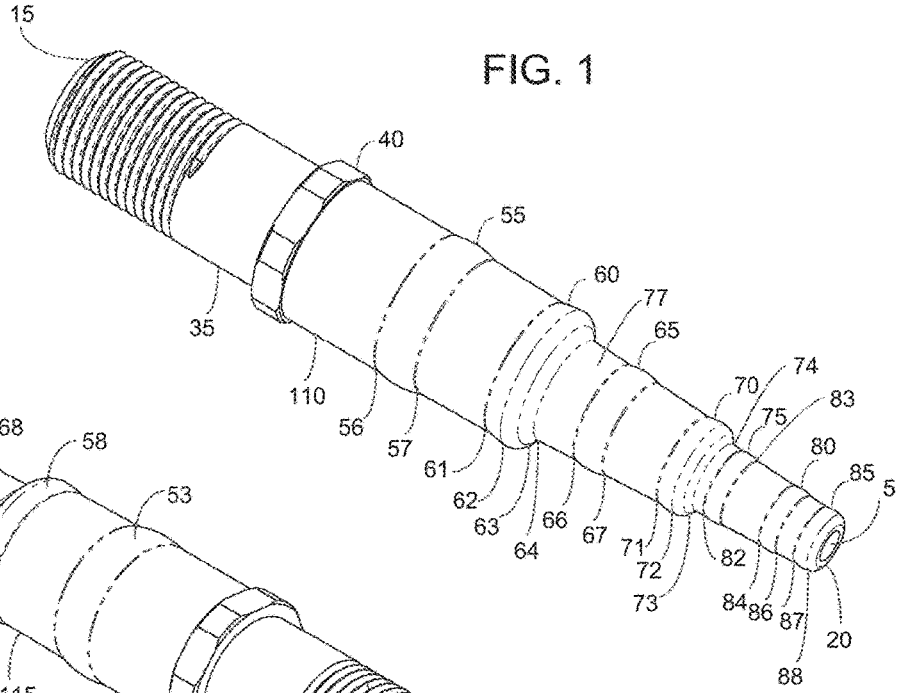
FIG. 1 shows a bottom perspective view of a nozzle.

Automatic pipette systems are machines or robots used in the chemical and biological fields to automatically pipette precise volumes of fluids from one place to another, without the need for direct human involvement. To avoid contamination, many automatic pipette systems use disposable pipette tips. The tip housing, sometimes referred to as a head (e.g., a head component), on some automated fluid delivery devices (e.g., automated pipette systems) has one or more nozzles configured to receive a pipette tip (e.g., a disposable pipette tip) of a specific size and dimension. Sometimes, a nozzle on a fluid delivery device accommodates only one size of a pipette tip. A pipette tip of a given size often is best suited for pipetting a limited range of volumes of fluid.

An automated fluid delivery device (e.g., an automated pipette system, a robotic fluid delivery device) can include a fluid delivery actuator component. A fluid delivery actuator component is sometimes referred to as a head component assembly. A head component assembly of an automated fluid delivery device sometimes comprises a housing (e.g., a head component 350, a head, a pipette head), one or more ejector bars (e.g., ejector rods), an array of nozzles and optionally an ejector plate. In some embodiments a fluid delivery actuator component is a head member of a robotic fluid delivery device. In some cases a nozzle attached to a head member is removable and in some cases a nozzle can not be removed from a head member.

As commercially available multichannel pipette systems are typically manufactured and configured for a specific pipette tip size, they are often restricted to dispensing a narrow range of volumes. Some processes require that a wider range of volumes of fluid is transferred. In such instances, the pipette housing (e.g., pipette head) must dispense fluids in multiple iterations to cumulatively transfer a volume, or human intervention is required to transfer the volume, that cannot be effectively handled by the pipette system. In some manufactured automated pipette systems, re-configuring the system to accommodate a pipette tip of a different size is possible, however the re-configuration process is time consuming, involved, requires some mechanical expertise and/or is often impractical for short term use of the system. Presented herein are pipette system devices for an automated multichannel pipette system.

Universal Nozzle

In some embodiments, a universal nozzle 10 comprises a proximal terminus 15, a distal terminus 20, a proximal region 30, a distal region 150 and an interior bore 5 terminating at each of the proximal terminus and the distal terminus. In some embodiments a nozzle is substantially tubular and sometimes comprises a substantially tubular exterior surface. The interior bore often terminates with an opening (e.g., an aperture) on both the proximal terminus and the distal terminus. In some cases the proximal terminus comprises a substantially planar surface 8 (i.e., flat surface). In some cases the proximal terminus comprises a bevel 7 configured to mate and/or seal with a head member. A proximal terminus of the bore generally comprises an aperture that that often has a diameter ranging from about 0.2 to about 0.3 inches. Sometimes the diameter of the aperture is from about 0.21 to about 0.29, or about 0.22 to about 0.28 inches. Sometimes the diameter of the aperture is about 0.22, 0.23, 0.24, 0.25, 0.26, 0.27 or about 0.28 inches. In some embodiments a distal terminus of the bore generally comprises an aperture. In some embodiments an internal bore 5 is substantially centered along a longitudinal axis 54 of the nozzle 10. Sometimes an internal bore comprises and/or defines a cylindrical void. In some cases the interior of an internal bore comprises a substantially smooth surface. In some embodiments the diameter of a cylindrical internal bore is about 0.03 to about 0.1 inches. Sometimes the diameter of a cylindrical internal bore is about 0.03, 0.04, 0.05, 0.06, 0.07, 0.08, 0.09 or about 0.1 inches. Sometimes the interior wall of the inner bore comprises a taper from a proximal portion to a distal portion (e.g., proximal aperture to distal aperture). In some cases the internal bore tapers from wide (e.g., at the proximal terminus) to narrow (e.g., at the distal terminus). In some embodiments the diameter of the internal bore is substantially the same from the proximal terminus to the distal terminus.

In some embodiments a nozzle comprises a metal. In some embodiments a nozzle is manufactured from a metal. Non-limiting examples of a metal are aluminum, steel, steel alloy stainless steel, brass, nickel, copper, lead, gold, silver, chrome, titanium, the like or a combination thereof. In some embodiments a nozzle is plated (e.g., gold plated, chrome plated). In some embodiments a nozzle comprises plastic or a plastic polymer (e.g., polypropylene, polycarbonate, the like or mixtures thereof).

In some embodiments a proximal region is configured to sealingly connect a nozzle to a head member. As used herein the term "sealingly" generally means to seal (e.g., to establish an air-tight seal and/or to establish a liquid tight seal). In some embodiments the proximal region comprises a connector (e.g., a region that is configured to connect a nozzle to a head member). In some embodiments a connector is configured to reversibly engage a connector counterpart of a fluid delivery system (e.g., a head member). Sometimes a suitable connector or connector method is used to attach a universal nozzle to a head member of a pipette system. Non-limiting examples of a connector and/or connector method include a threaded fitting (an internal, external, male or female threaded fitting), beaded fitting, barbed fitting, compression fitting, flare fitting, bite-type fitting, mechanical grip-type fitting, O-ring face seal fitting, the like or combinations thereof. Sometimes a connector comprises a threaded member 25. Sometimes a connector comprises a tool engagement member 40. A tool engagement member is sometimes configured for gripping a nozzle with a tool (e.g., a wrench, pliers, or the like) or for gripping with fingers and/or a hand. Sometimes a proximal region is configured to reversibly connect a nozzle to a head. In some embodiments a proximal region is configured to result in a seal (e.g., an air-tight seal, a liquid-tight seal) upon connection of a nozzle to a head member. In some embodiments a proximal region comprises a barrel portion 35. In some cases a connector (e.g., a proximal region) and or a barrel portion 35 is configured to accommodate a seal (e.g., an O-ring, a washer, the like or a combination thereof).

Figure 2:
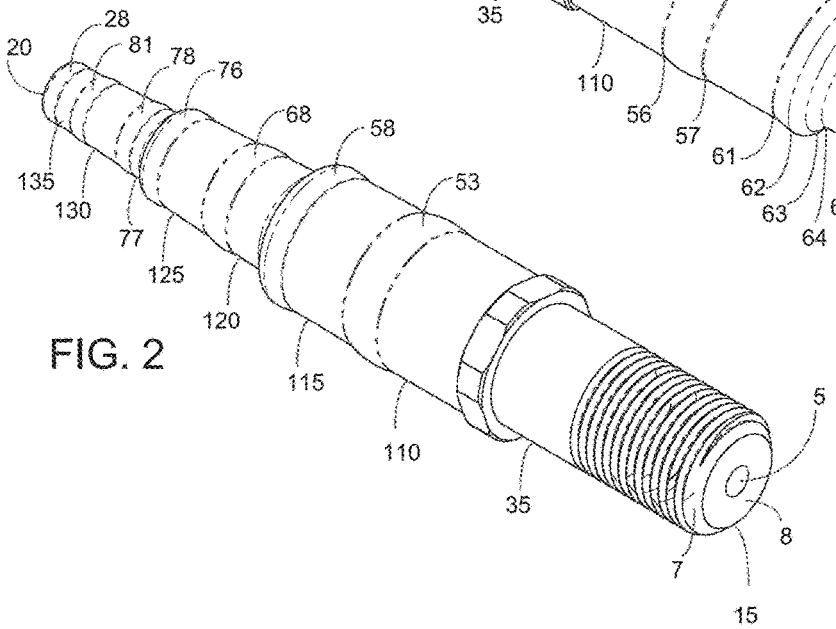
FIG. 2 shows a top perspective view of a nozzle.
Figure 3:
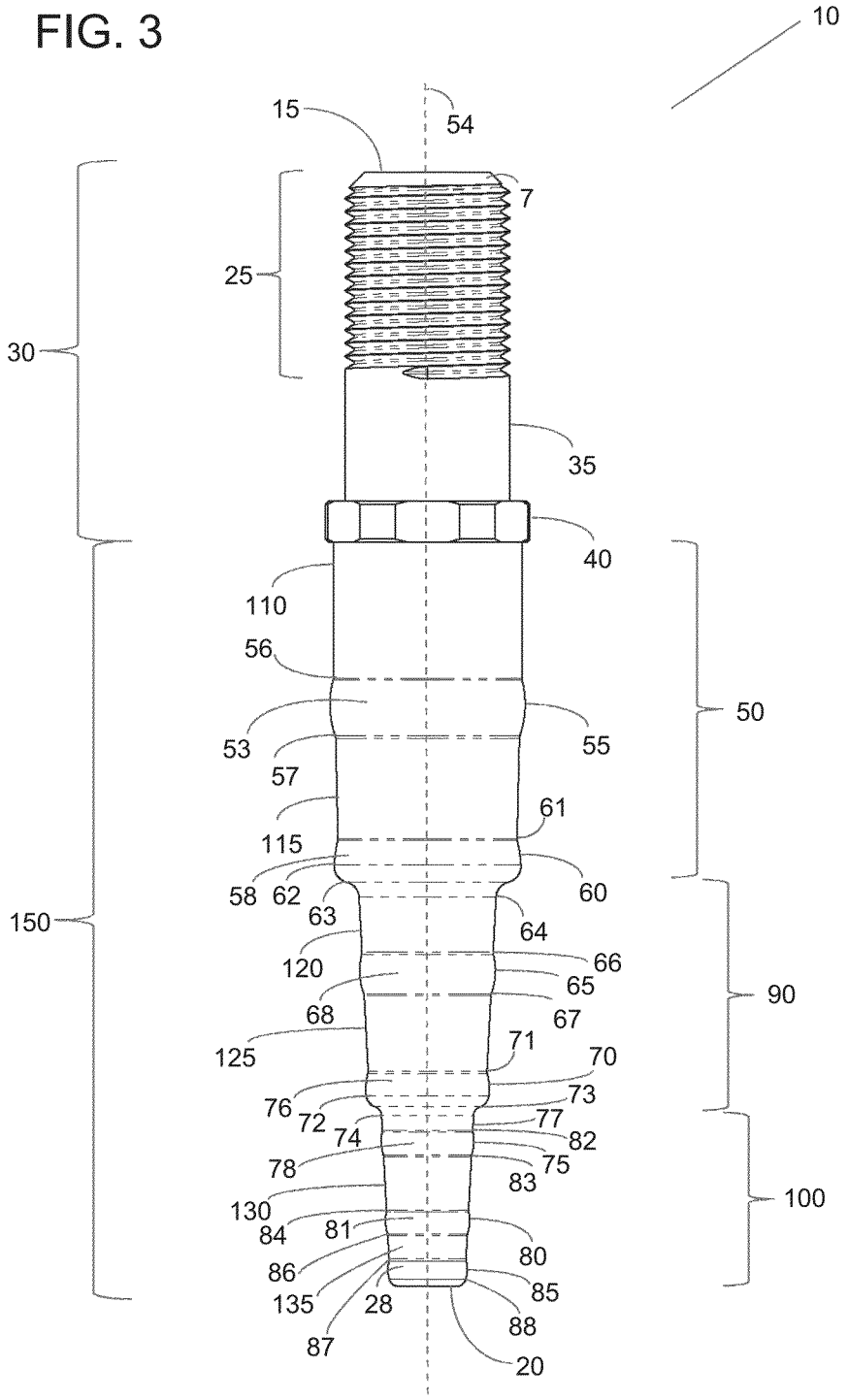
FIG. 3 shows a front view of a nozzle.
Figure 4:
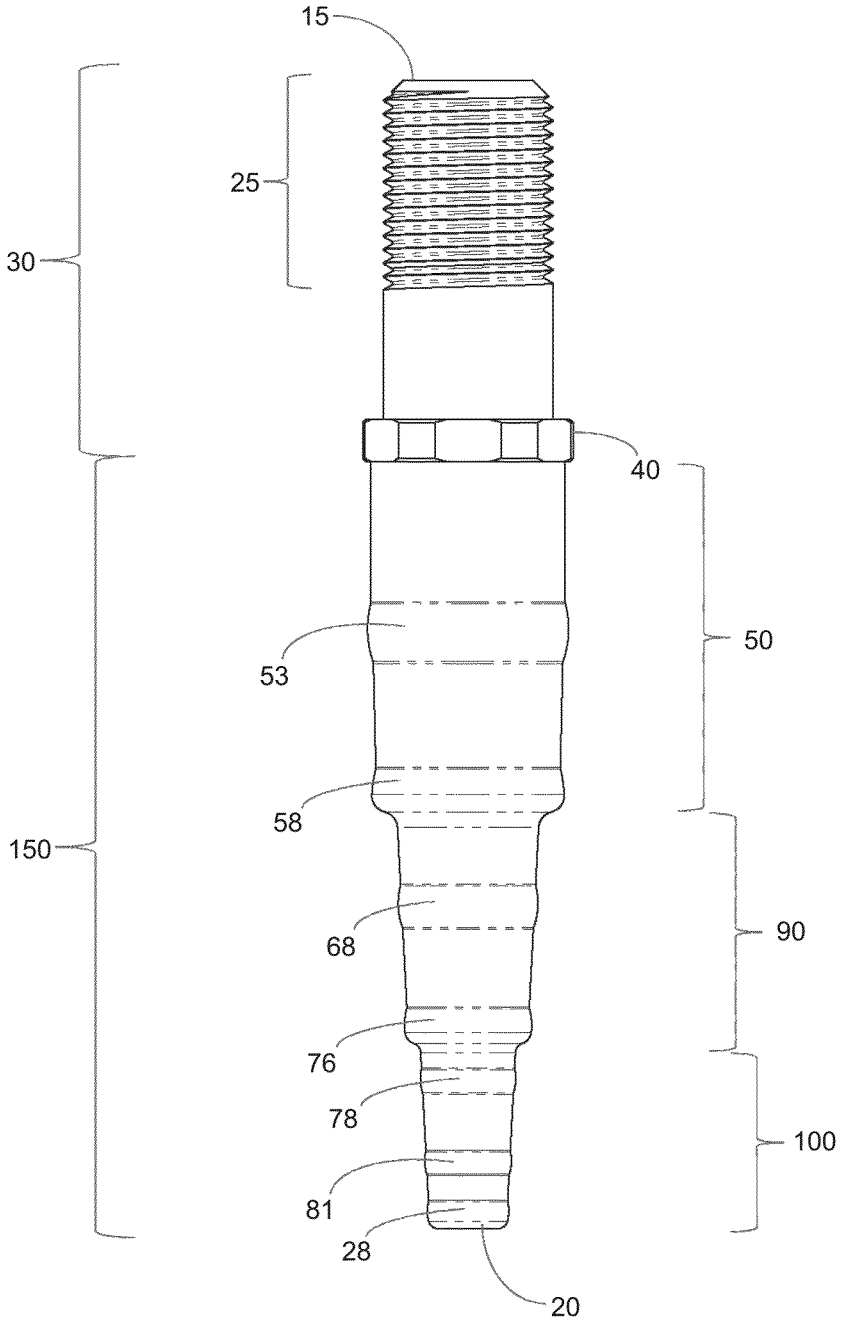
FIG. 4 shows a right side of a nozzle.
Figure 5:
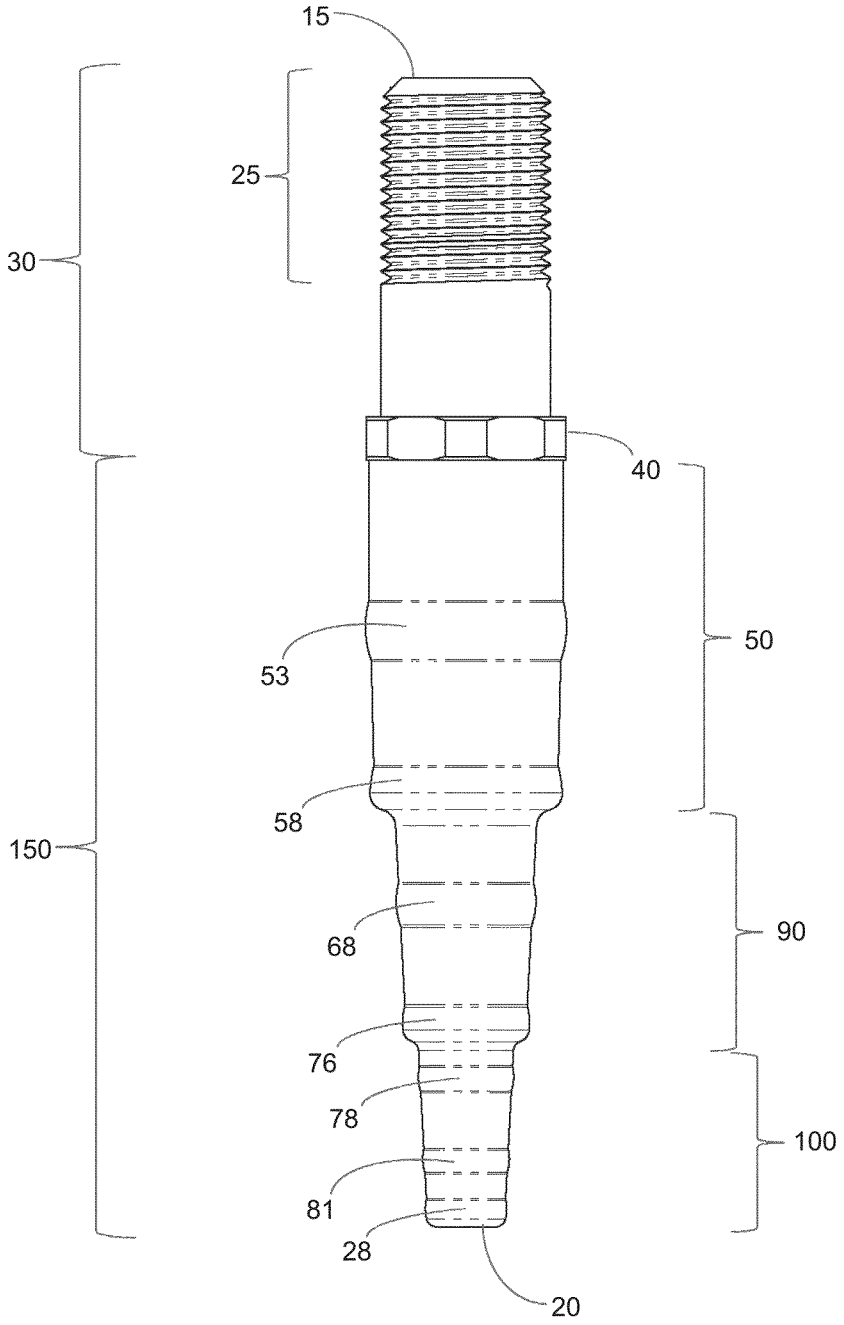
FIG. 5 shows a back view of a nozzle.
Figure 6:
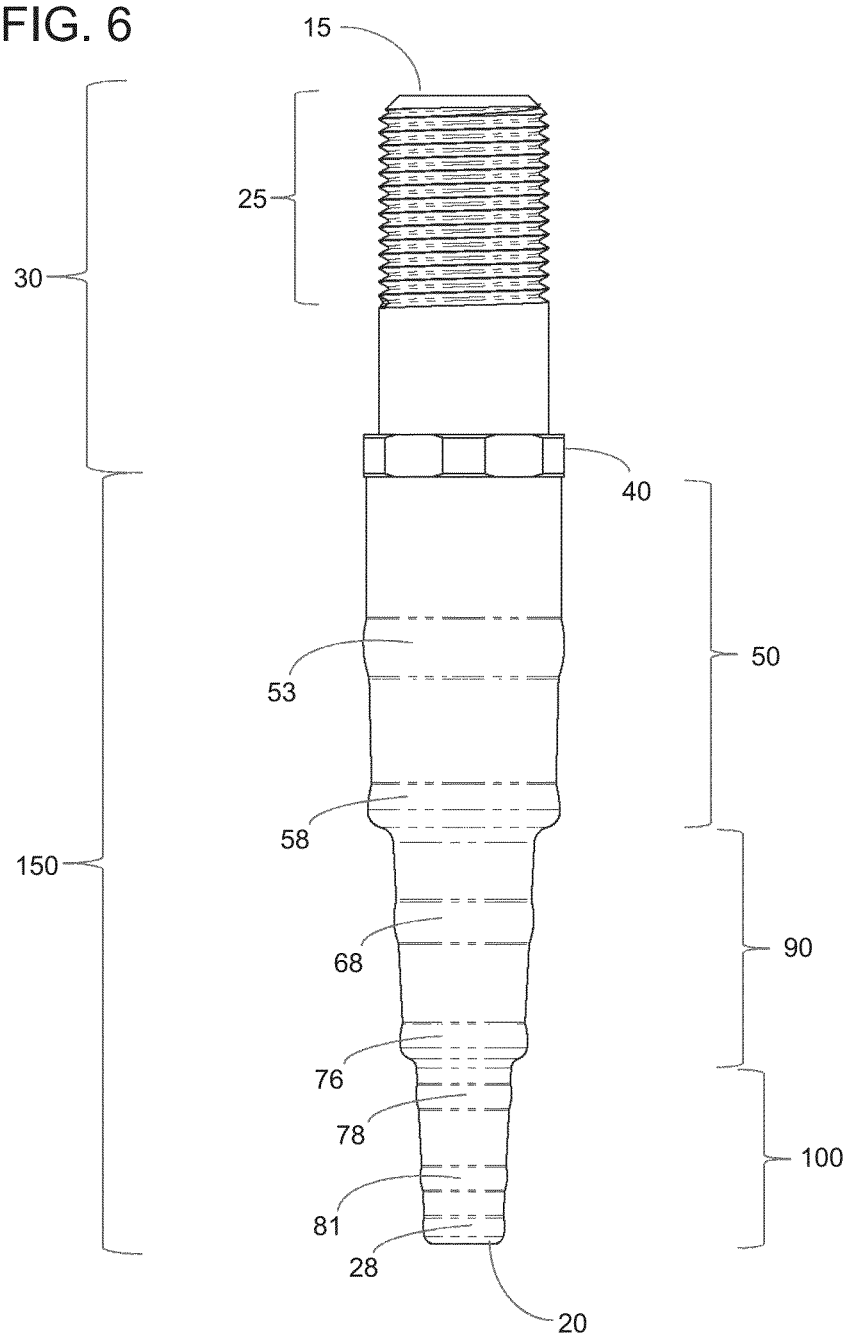
FIG. 6 shows a left side view of a nozzle.
Figure 7:
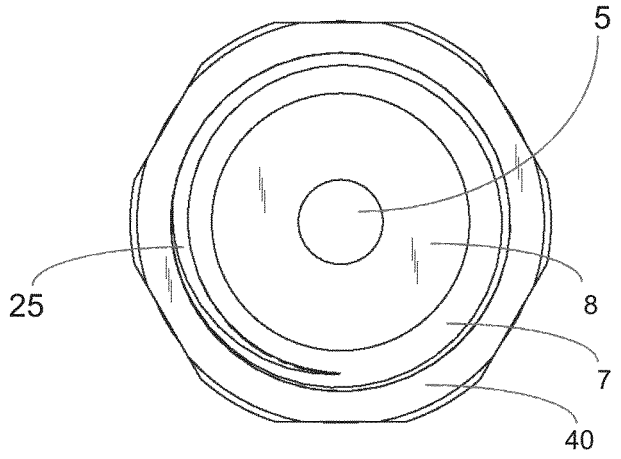
FIG. 7 shows a top view of a nozzle.
Figure 8:
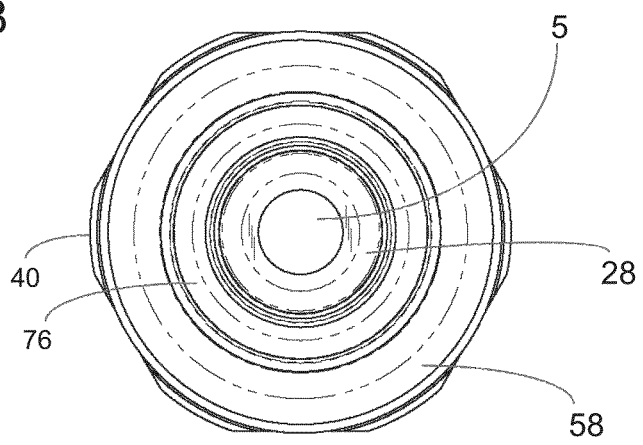
FIG. 8 shows a bottom view of a nozzle.
Figure 9:
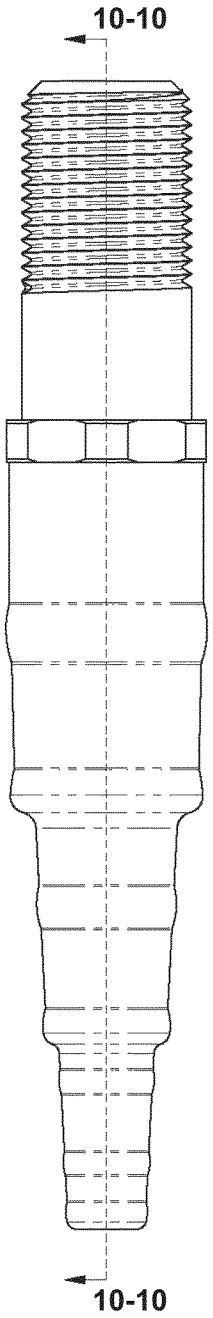
FIG. 9 shows a front view of a nozzle.
Figure 10:
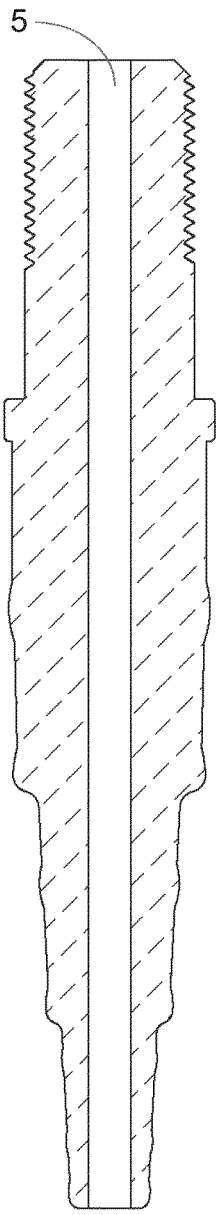
FIG. 10 shows a cross sectional view of a nozzle.
Figure 11:
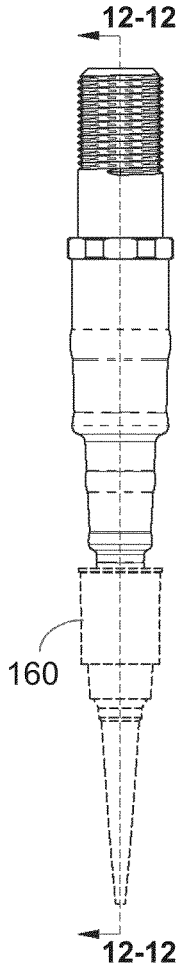
FIG. 11 shows a front view of a nozzle with a 10 ul pipette tip attached.
Figure 12:
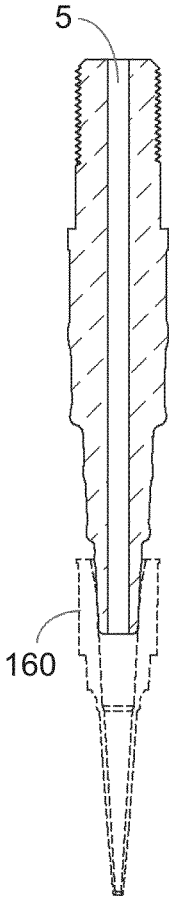
FIG. 12 shows a cross sectional view of a nozzle with a 10 ul pipette tip attached.
Figure 13:
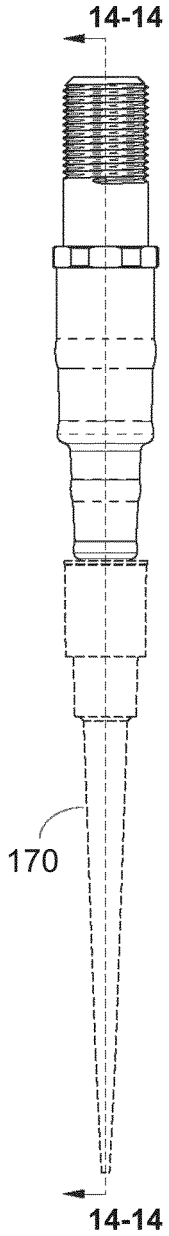
FIG. 13 shows a front view of a nozzle with a 10XL pipette tip attached.
Figure 14:
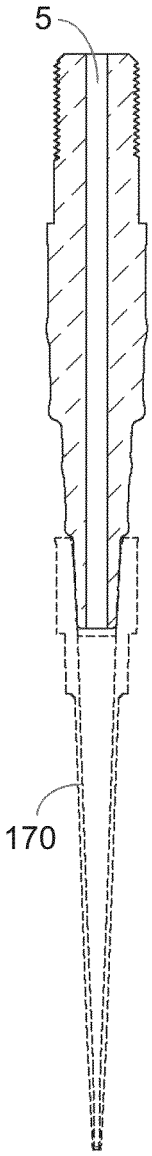
FIG. 14 shows a cross sectional view of a nozzle with a 10XL pipette tip attached.
Figure 15:
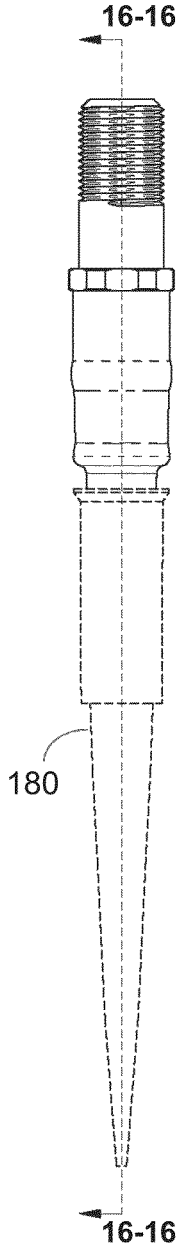
FIG. 15 shows a front view of a nozzle with a 200 ul pipette tip attached.
Figure 16:
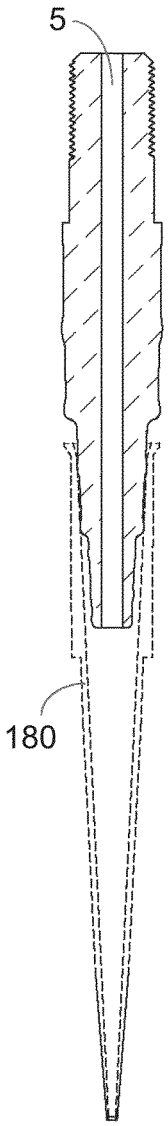
FIG. 16 shows a cross sectional view of a nozzle with a 200 ul pipette tip attached.
Figure 17:
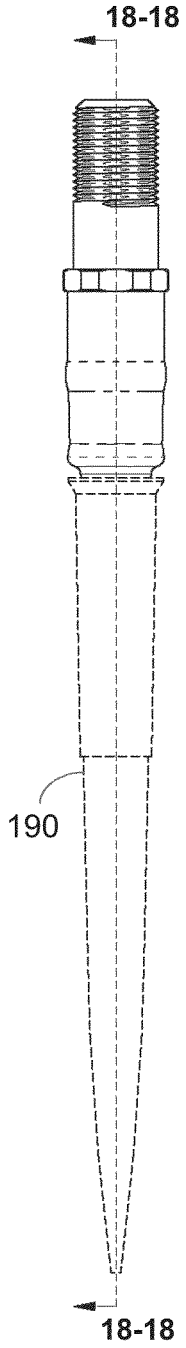
FIG. 17 shows a front view of a nozzle with a 300 ul pipette tip attached.
Figure 18:
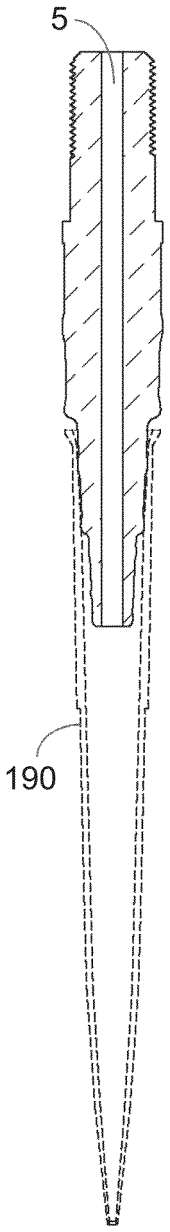
FIG. 18 shows a cross sectional view of a nozzle with a 300 ul pipette tip attached.
Figure 19:
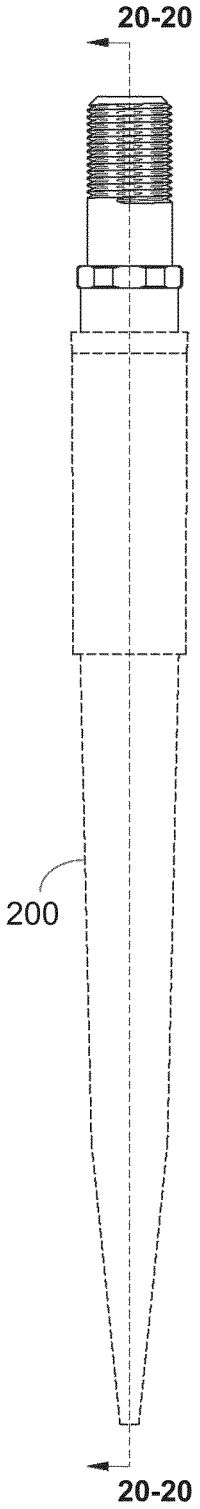
FIG. 19 shows a front view of a nozzle with a 1000 ul pipette tip attached.
Figure 20:
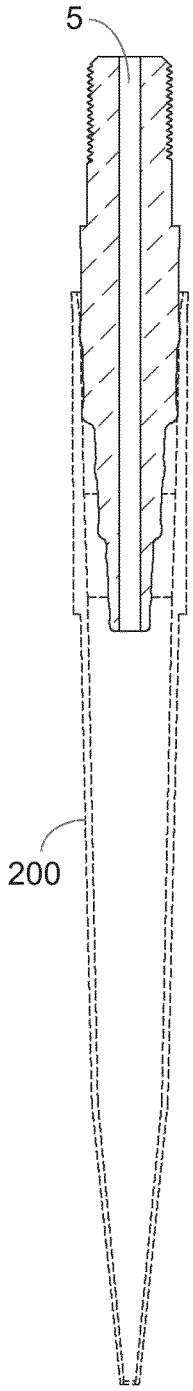
FIG. 20 shows a cross sectional view of a nozzle with a 1000 ul pipette tip attached.
Figure 21:
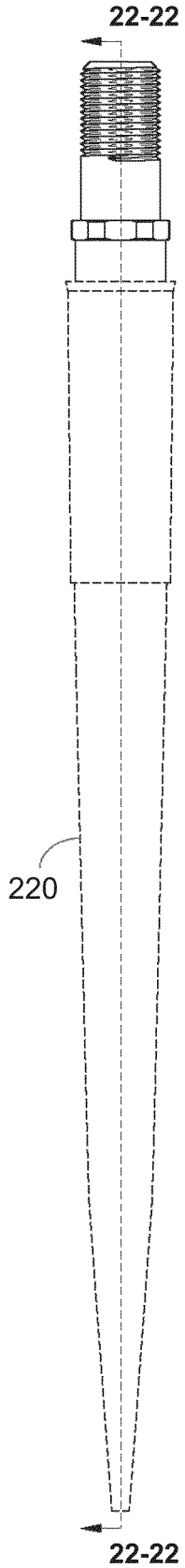
FIG. 21 shows a front view of a nozzle with a 1250 ul pipette tip attached.
Figure 22:
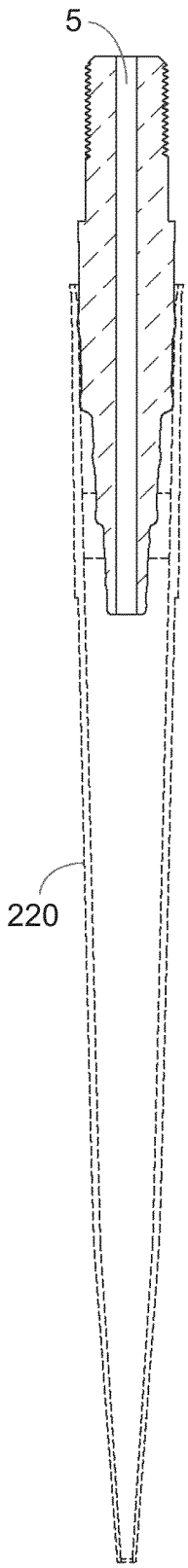
FIG. 22 shows a cross sectional view of a nozzle with a 1250 ul pipette tip attached.
Figure 23:
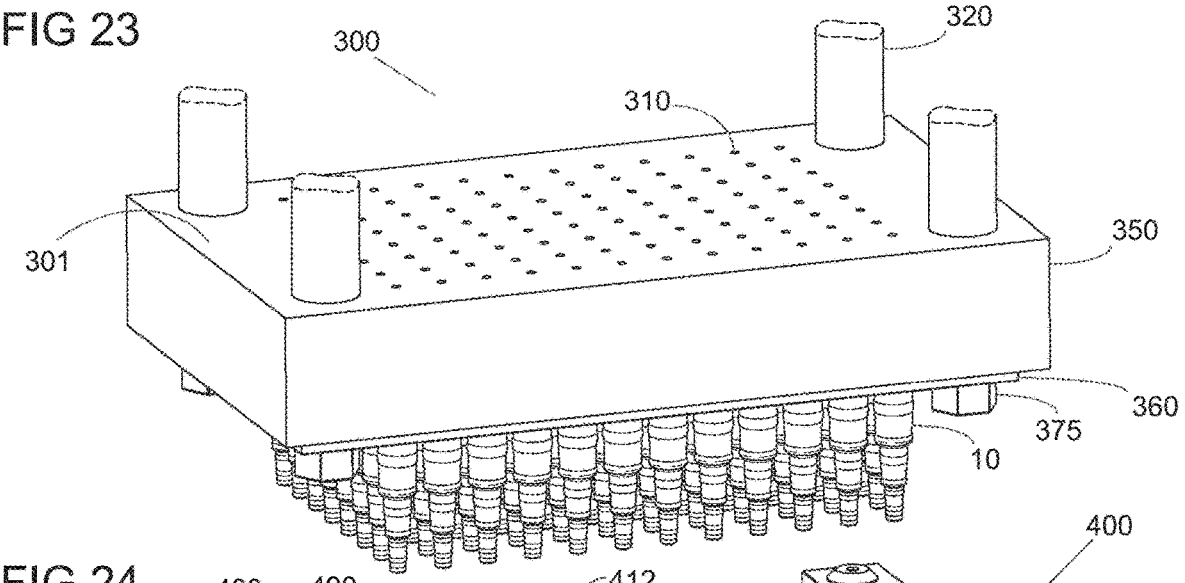
FIG. 23 shows a top perspective view of a head unit of an automated pipetting system comprising an ejection plate and nozzles.
Figure 24:
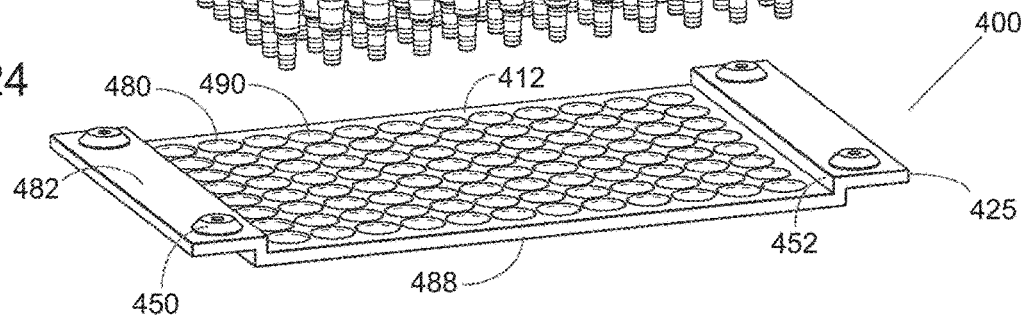
FIG. 24 shows a top perspective view of an ejection adapter plate.
Figure 25:
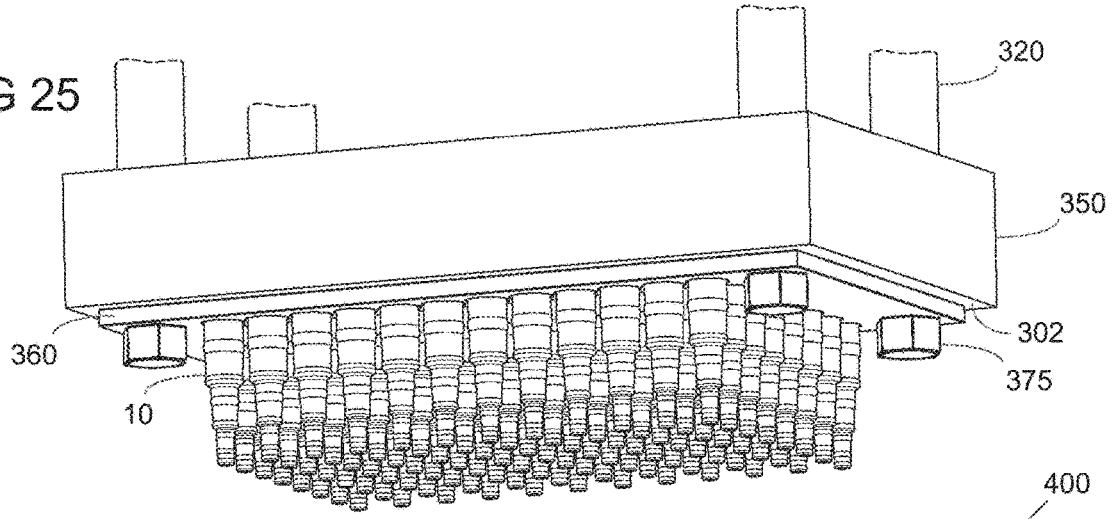
FIG. 25 shows a bottom perspective view of a head unit of an automated pipetting system comprising an ejection plate and nozzles.
Figure 26:
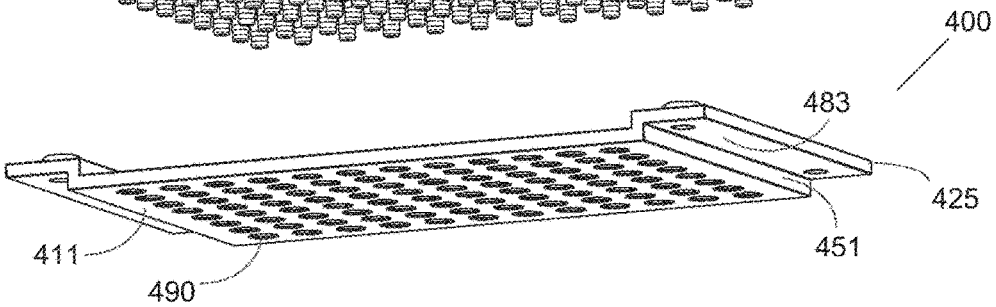
FIG. 26 shows a bottom perspective view of an ejection adapter plate.
Figure 27:
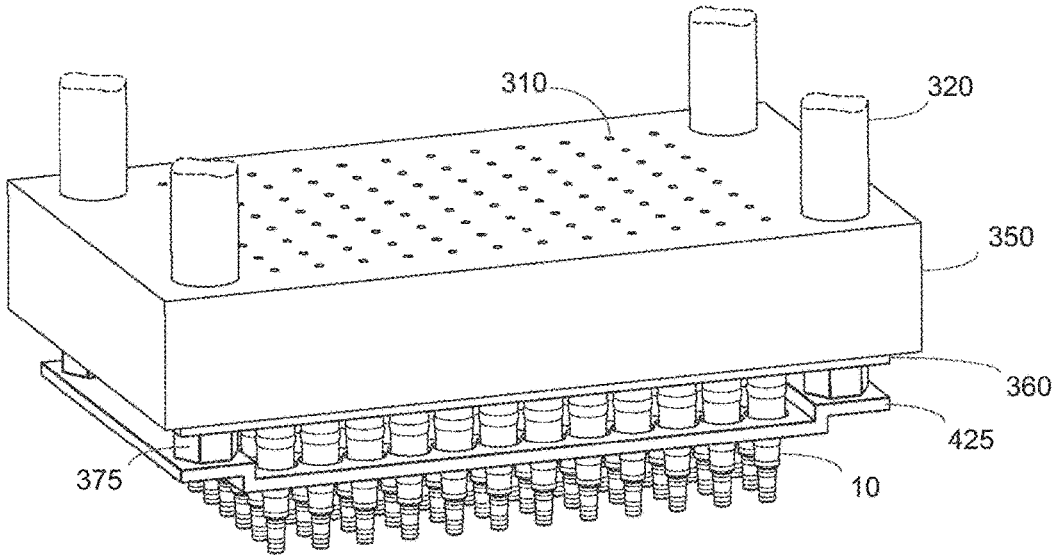
FIG. 27 shows a top perspective view of an automated pipetting system comprising a head unit, an ejection plate, nozzles and an ejection adapter plate.
Figure 28:
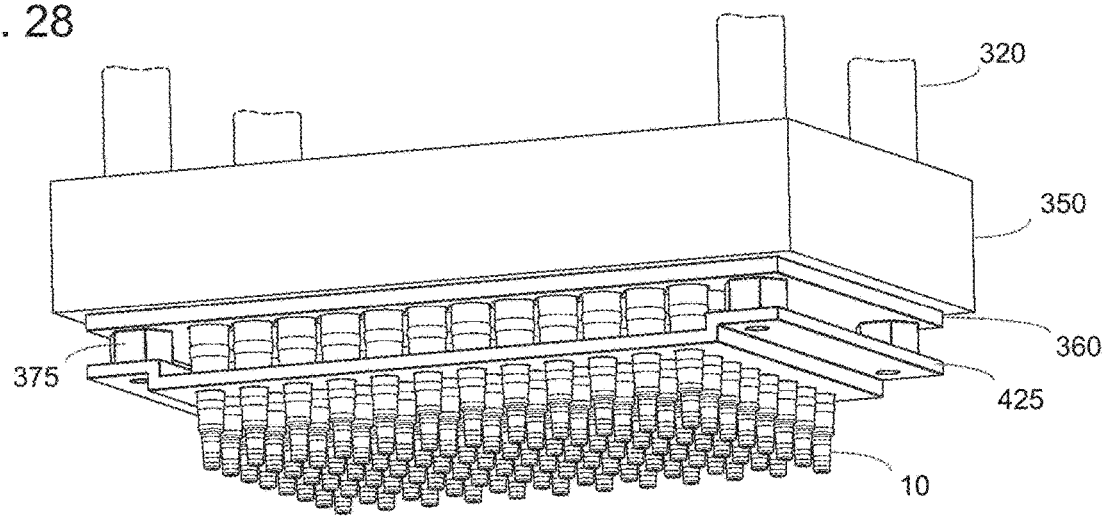
FIG. 28 shows a bottom perspective view of an automated pipetting system comprising a head unit, an ejection plate, nozzles and an ejection adapter plate.
Figure 29:
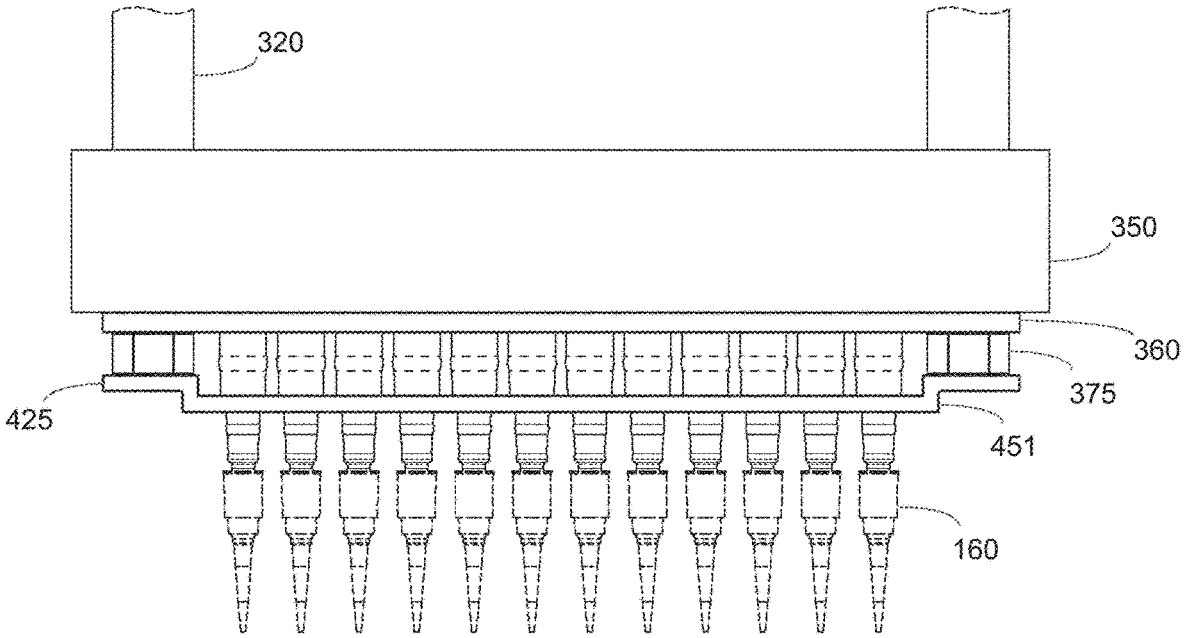
FIG. 29 shows a wide side view of an automated pipetting system comprising a head unit, an ejection plate, nozzles, an ejection adapter plate and small pipette tips attached to the nozzles.
Figure 30:
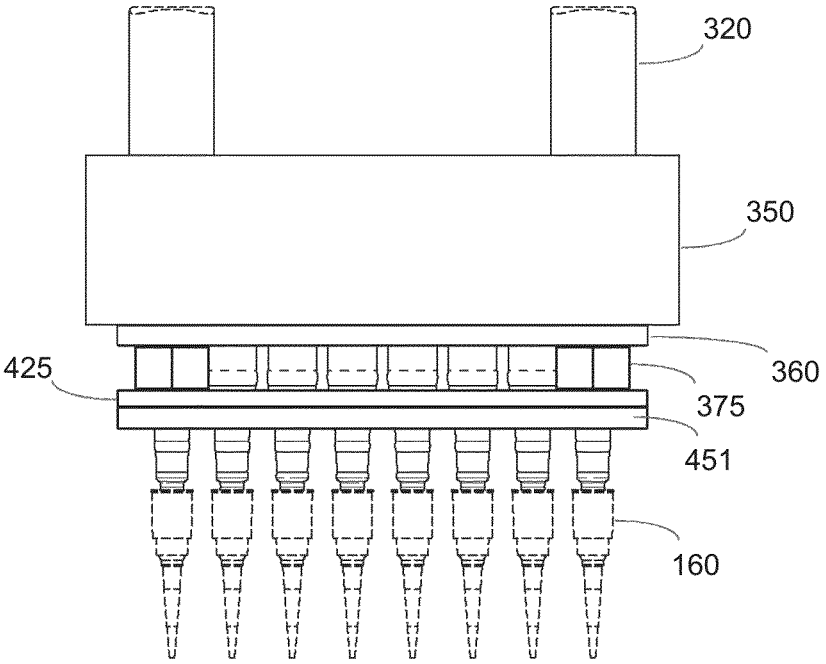
FIG. 30 shows a narrow side view of an automated pipetting system comprising a head unit, an ejection plate, nozzles, an ejection adapter plate and small pipette tips attached to the nozzles.
Figure 31:
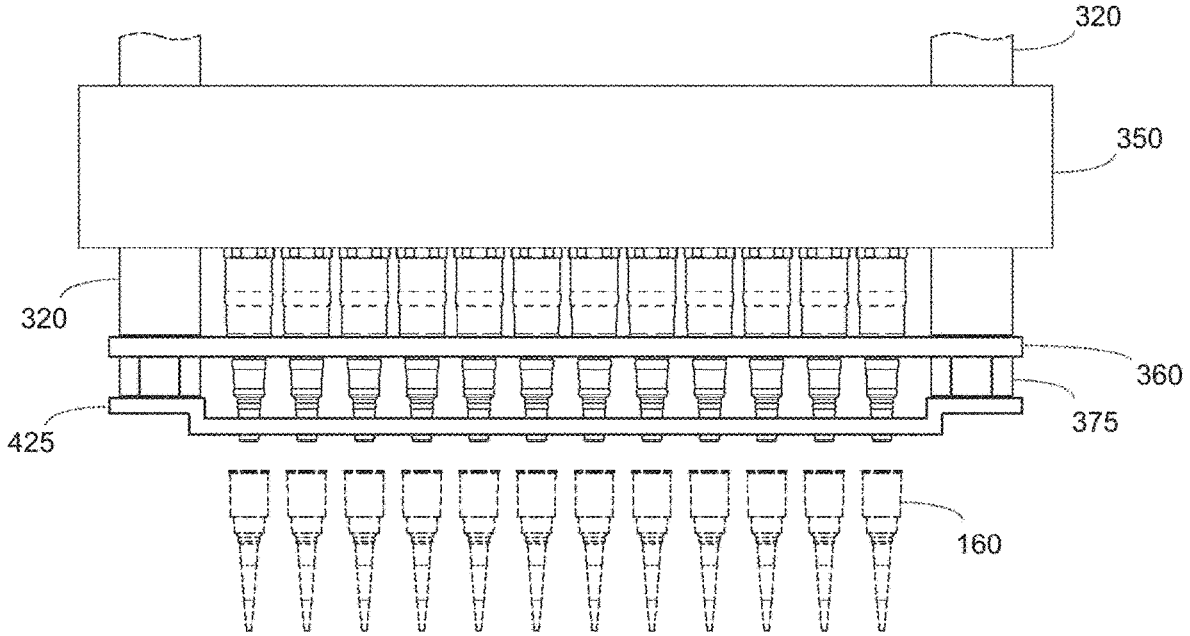
FIG. 31 shows a wide side view of an automated pipetting system comprising a head unit, an ejection plate, nozzles, an ejection adapter plate in a down position and small pipette tips ejected from the nozzles.
Figure 32:
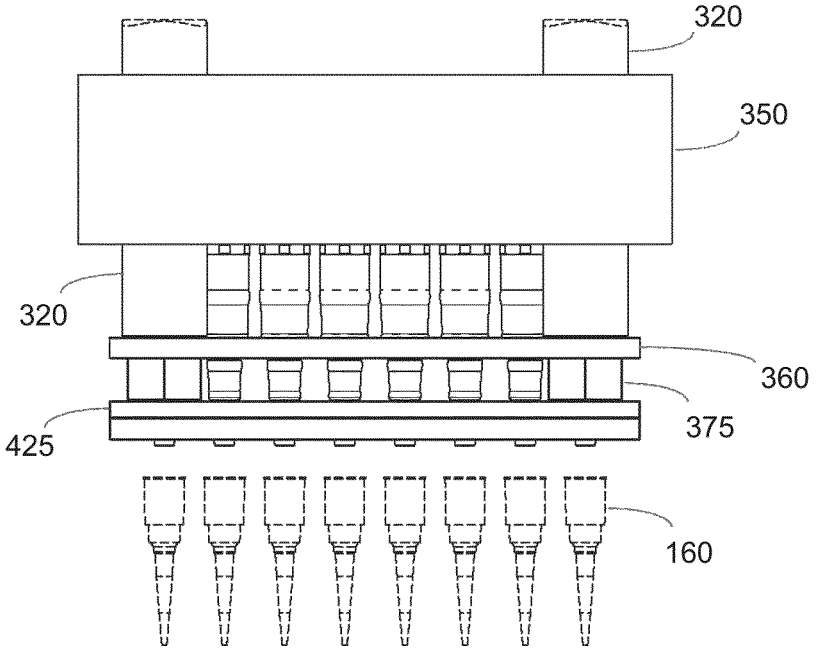
FIG. 32 shows a narrow side view of an automated pipetting system comprising a head unit, an ejection plate, nozzles, an ejection adapter plate in a down position and small pipette tips ejected from the nozzles.
Figure 33:
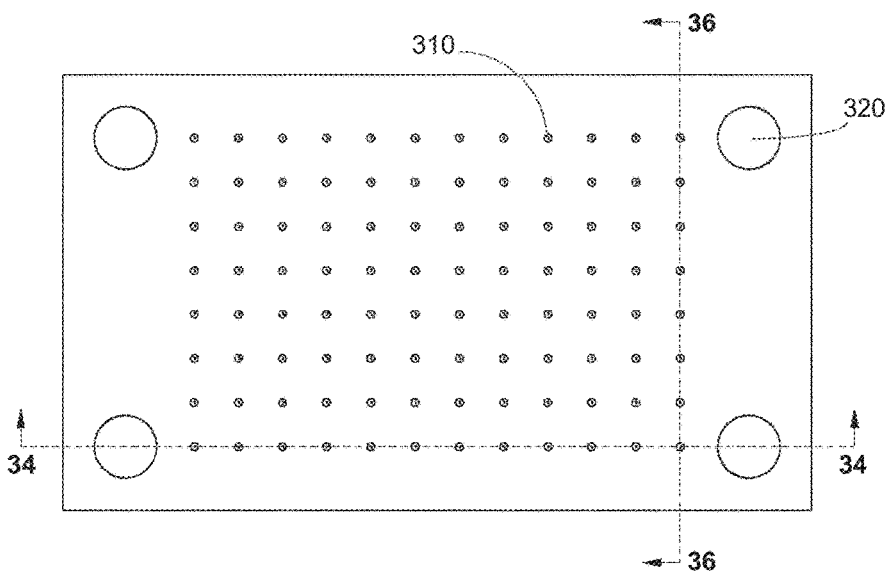
FIG. 33 shows a top view of a head unit of an automated pipetting system.
Figure 34:
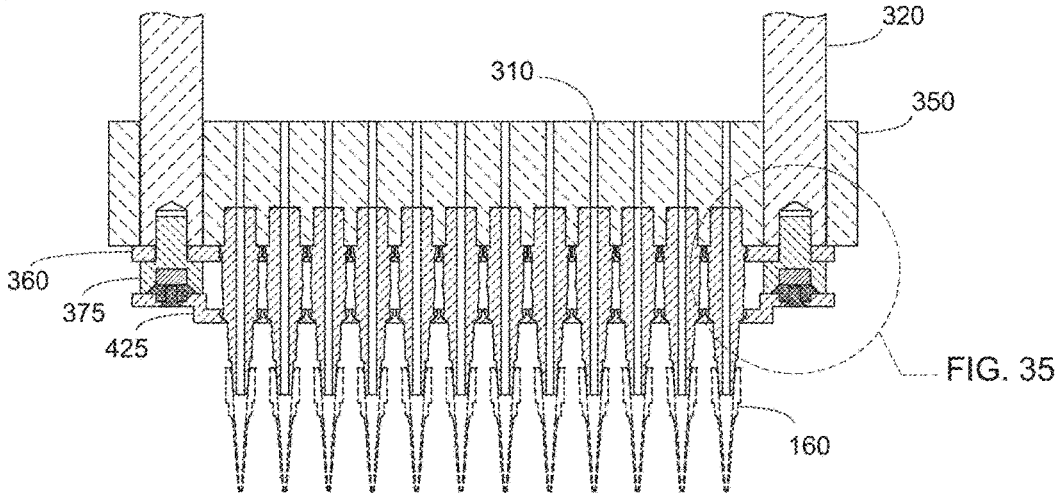
FIG. 34 shows a cross sectional wide side view of an automated pipetting system comprising a head unit, an ejection plate, nozzles, an ejection adapter plate and small pipette tips attached to the nozzles.

In some embodiments, the distal region 150 of a universal nozzle 10 comprises one or more pipette tip association members (e.g., 50, 90, 100 shown in FIG. 3). Sometimes a pipette tip association member is configured to receive one or more pipette tips of different sizes (e.g., having sealing zones of substantially different diameters). A distal region of a nozzle and/or a pipette tip association member comprises one or more body regions (e.g., 110, 115, 120, 125, 130, 135). In some embodiments each body region decreases in diameter from the proximal terminus to the distal terminus. For example, in some cases the diameter of 110 is larger than 115, 115 is larger than 120, 120 is larger than 125, 125 is larger than 130 and/or 130 is larger than 135. In some embodiments the external longitudinal surface of the body regions of a pipette tip association member, not including a sealing zone or transition zone, are collinear. For example, sometimes the external surface of 110 is collinear with 115, 120 is collinear with 125, and 130 is collinear with 135, as shown in FIG. 1-3. Sometimes a pipette tip association member is configured to sealingly associate and/or reversibly attach to a pipette tip. Sometimes a distal region 150 comprises 1, 2, 3, 4, 5 or 6 pipette tip association members. In some embodiments, a distal region comprises a first pipette tip association member 50, a second pipette tip association member 90 and a third pipette tip association member 100.

In some embodiments a first pipette tip association member 50 is located adjacent to and proximal to a second pipette tip association member 90, where the second pipette tip association member 90 is located distal to the first pipette association member. In some embodiments a third pipette tip association member 100 is located adjacent to and distal to a second pipette tip association member 90. In some embodiments a pipette association member comprises a proximal and/or a distal boundary. Sometimes a first pipette association member has a proximal boundary at our about the proximal boundary of the distal region 150. Sometimes a first pipette association member has a boundary at our about the proximal boundary of a second or a third pipette association member. Sometimes a first pipette association member has a distal boundary (e.g., located at 63 in FIG. 1 and FIG. 3). In some cases a second pipette association member has a proximal boundary (e.g., located at 64 in FIG. 1 and FIG. 3). Sometimes a second pipette association member has a distal boundary (e.g., 73 in FIG. 1 and FIG. 3). Sometimes a nozzle comprises a first and a second pipette association member and a distal boundary of the second pipette association member is located at the distal terminus. In some embodiments a third pipette association member has a proximal boundary (e.g., 74 in FIG. 1 and FIG. 3). In some embodiments a distal boundary of the third pipette association member is located at the distal terminus of the nozzle.

In some embodiments a pipette tip association member (e.g., a first, second or third member) comprises a body where the body comprises an exterior surface and a mean circumference. In some embodiments the body, a body region, or a pipette tip association member is substantially cylindrical comprising a frustoconical shape. Sometimes the longitudinal exterior surface of a body or body region of a pipette tip association member substantially tapers from the proximal boundary to the distal boundary of a pipette tip association member. In some cases there is no taper where a sealing zone protrudes from the exterior surface of the body. For example, sometimes a pipette tip association member has a smaller cross-sectional diameter at its distal boundary than at its proximal boundary. In some embodiments the exterior surface of a body of a pipette tip association member is substantially parallel from the proximal boundary to the distal boundary of the body. For example, sometimes a pipette tip association member has a cross-sectional diameter at its distal boundary that is approximately equal to the cross-sectional diameter at its proximal boundary. Sometimes a mean circumference is a mean of the circumference of the body of a pipette tip association member (e.g., body sections 110 and 115, 120 and 125, or 130 and 135), not including any protruding surfaces (e.g., sealing zones). Sometimes a mean circumference is a mean of the circumference of the body including zones (e.g., sealing zones) that protrude from the exterior surface of the body.

In some embodiments a distal region comprises a first pipette tip association member. In some embodiments, a distal region comprises a first pipette tip association member 50. Sometimes a first pipette tip association member 50 is located adjacent and distal to a tool engagement member. In some embodiments a first pipette tip association member is generally cylindrical comprising a frustoconical shape tapering at an angle of about 0.8 to about 1.9 degrees, relative to the longitudinal axis of the nozzle. In some cases a first pipette tip association member tapers at an angle of about 0.8, 0.9, 1.0, 1.2, 1.3, 1.4, 1.5, 1.6, 1.7, 1.8, or about 1.9 degrees. Sometimes a first pipette tip association member tapers at an angle of 1.3 degrees. In some embodiments a first pipette tip association member comprises an outer diameter configured for receiving a relatively large pipette tip, for example tips designed for dispensing a maximum volume between 500 ul and 2000 ul (e.g., 500 ul, 750 ul, 1000 ul, 1250 ul, 1500 ul, 1750 ul or 2000 ul). In some cases, a first pipette tip association member comprises an outer diameter that ranges from about 0.30 inches to about 0.250 inches. In some embodiments, the widest proximal portion of a first pipette tip association member is about 0.320, 0.315, 0.310, 0.305, 0.300, 0.299, 0.298, 0.297, 0.296, 0.295, 0.294, 0.293, 0.292, 0.291, 0.290, 0.289, 0.288, 0.287, 0.286, 0.285, 0.284, 0.283, 0.282, 0.281 or about 0.280 inches in outer diameter. In some embodiments, the narrowest, distal most portion of a first pipette tip association member is about 0.295, 0.294, 0.293, 0.292, 0.291, 0.290, 0.289, 0.288, 0.287, 0.286, 0.285, 0.284, 0.283, 0.282, 0.281, 0.280, 0.279, 0.278, 0.277, 0.276 or about 0.275 in outer diameter. The height (e.g., length as measured from the proximal boundary to the distal boundary) of a first pipette tip association member sometimes is about 0.45 to about 1.0 inches. In some cases, the height of a first pipette tip association member is about 0.45, 0.50, 0.55, 0.60, 0.65, 0.70, 0.75, 0.80, 0.85, 0.90 or about 1.0 inches. Sometimes the height of a first pipette tip association member is about 0.44, 0.45, 0.46, 0.47, 0.48, 0.49, 0.50, 0.51, 0.52, 0.53, 0.54, 0.55, 0.56, 0.57, 0.58, 0.59 or about 0.60 inches.

In some embodiments a distal region comprises a second pipette tip association member. In some embodiments a second pipette tip association member 90 is located distal to a first pipette tip association member 50. In some embodiments a second pipette tip association member 90 is located between a first pipette tip association member 50 and a third pipette tip association member 100. Sometimes a nozzle has no third pipette tip association member. In some embodiments a second pipette tip association member is generally cylindrical comprising a frustoconical shape tapering at an angle of about 2.5 to about 3.5 degrees, relative to the longitudinal axis of the nozzle. Sometimes a second pipette tip association member tapers at an angle of about 2.5, 2.6, 2.7, 2.8, 2.9, 3.0, 3.1, 3.2, 3.3, 3.4, or about 3.5 degrees. In some cases a second pipette tip association member tapers at an angle of 3.0 degrees. In some embodiments a second pipette tip association member comprises an outer diameter configured for receiving relatively medium size pipette tips, for example tips designed for dispensing a maximum volume between 200 ul and 500 ul (e.g., 150 ul, 200 ul, 250 ul, 300 ul, 350 ul, 400 ul or 500 ul). In some cases, a second pipette tip association member comprises an outer diameter that ranges from about 0.25 inches to about 0.17 inches. In some embodiments, the widest proximal portion of a second pipette tip association member is about 0.240, 0.235, 0.230, 0.225, 0.220, 0.219, 0.218, 0.217, 0.216, 0.215, 0.214, 0.213, 0.212, 0.211, 0.210, 0.209, 0.208, 0.207, 0.206, 0.205, 0.200, 0.195 or about 0.190 inches in outer diameter. In some embodiments, the narrowest, distal portion of a second pipette tip association member is about 0.190, 0.189, 0.188, 0.187, 0.186, 0.185, 0.184, 0.183, 0.182, 0.181, 0.180, 0.179, 0.178, 0.177, 0.176, 0.175, 0.174, 0.173, 0.172, 0.171, 0.170, 0.169, 0.168, 0.167, 0.166, 0.165, 0.164, 0.163, 0.162, 0.161, 0.160, 0.159, 0.158, 0.157, 0.156, 0.155, 0.154, or about 0.153 inches in outer diameter. The height (e.g., length as measured from proximal to distal) of a second pipette tip association member sometimes is about 0.20 to about 0.35 inches. In some cases, the height of a second pipette tip association member is about 0.15, 0.2, 0.25, 0.30 or about 0.35 inches. Sometimes the height of a second pipette tip association member is about 0.21, 0.22, 0.23, 0.24, 0.25, 0.26, 0.27, 0.28, 0.29, 0.30, 0.31, 0.32, 0.33, 0.34, 0.35 or about 0.36 inches.

In some embodiments a distal region comprises a third pipette tip association member. In some embodiments a third pipette tip association member 100 is located distal to a second pipette tip association member 90. In some embodiments a third pipette tip association member 100 is located between a second pipette tip association member 90 and a distal terminus 20. In some embodiments the exterior surface of a body of a third pipette tip association member 100 tapers at an angle of about 2.5 to about 3.5 degrees, relative to the longitudinal axis of the nozzle. Sometimes a third pipette tip association member tapers at an angle of about 2.5, 2.6, 2.7, 2.8, 2.9, 3.0, 3.1, 3.2, 3.3, 3.4, or about 3.5 degrees. Sometimes a third pipette tip association member tapers at an angle of 3.0 degrees. In some embodiments a third pipette tip association member comprises an outer diameter configured for receiving relatively smaller pipette tips, for example tips designed for dispensing a maximum volume between 0.5 and 100 ul (e.g., 1 ul, 5 ul, 10 ul, 20 ul, 50 ul or 100 ul). In some cases, a third pipette tip association member comprises an outer diameter that ranges from about 0.16 inches to about 0.10 inches. In some embodiments, the widest, proximal portion of a third pipette tip association member is about 0.160, 0.159, 0.158, 0.157, 0.156, 0.155, 0.154, 0.153, 0.152, 0.151, 0.150, 0.149, 0.148, 0.147, 0.146, 0.145, 0.144, 0.143, 0.142, 0.141, 0.140, 0.139, 0.138, 0.137, 0.136, or about 0.135 inches in outer diameter. In some embodiments, the narrowest, distal portion of a third pipette tip association member is about 0.125, 0.124, 0.123, 0.122, 0.121, 0.120, 0.119, 0.118, 0.117, 0.116, 0.115, 0.114, 0.113, 0.112, 0.111, 0.110, 0.109, 0.108, 0.107, 0.106, 0.105, 0.104, 0.103, 0.102, 0.101, or about 0.100 inches in outer diameter. The height (e.g., length as measured from proximal to distal) of a third pipette tip association member is about 0.15 to about 0.35 inches. In some cases, the height of a third pipette tip association member is about 0.15, 0.2, 0.25, 0.30 or about 0.35 inches. Sometimes the height of a third pipette tip association member is about 0.21, 0.22, 0.23, 0.24, 0.25, 0.26, 0.27, 0.28, 0.29 or about 0.3 inches.

In some embodiments the mean circumference of a first pipette tip association member is larger than the mean circumference of a second and/or a third pipette tip association member. In some cases the mean circumference of a second pipette tip association member is larger than the mean circumference of a third pipette tip association member. In some embodiments a pipette tip that sealingly associates with a first pipette tip association member cannot sealingly associate with a second and/or a third pipette tip association members. In some cases a pipette tip that sealingly associates with a second pipette tip association member cannot sealingly associate with a first and/or a third pipette tip association member. In some embodiments a pipette tip that sealingly associates with a third pipette tip association member cannot sealingly associate with a first and/or a second pipette tip association member.

Pipette Tip Sealing Zones

In some embodiments, a pipette tip association member comprises one or more annular pipette tip sealing zones (e.g., 53, 58, 68, 76, 78, 81 and 28 in FIG. 2 and FIG. 3). In some cases an annular pipette tip sealing zones emanates from a first point on the exterior surface of a body and terminates at a second point on the exterior surface of the body where the first point is proximal to the second point.

An annular pipette tip sealing zone can be a first annular pipette tip sealing zone 53, a second annular pipette tip sealing zone 68 and/or a third annular pipette tip sealing zone 81. Sometimes an annular pipette tip sealing zone is an additional pipette tip sealing zone (e.g., 58, 76 and/or 28) and/or a supplementary annular pipette tip sealing zone (e.g., 78). In some cases an annular pipette tip sealing zone protrudes from the exterior surface of the body of a pipette tip association member and comprises a profile (e.g., profile 55, 60, 65, 70, 75, 80 and 85 in FIG. 1 and FIG. 3). In some embodiments an annular pipette tip sealing zone comprises a curved surface (e.g., a convex curved surface with respect to an exterior surface of the body of a pipette tip association member). For example in some cases a profile (e.g., profile 55, 60, 65, 70, 75, 80 and/or 85 in FIG. 1 and FIG. 3) comprises a curved surface. A protruding curved surface sometimes emanates from a first point on the exterior surface of the body and terminates at a second point on the exterior surface of the body, where the first point is proximal to the second point.

In certain embodiments, as shown in FIG. 3, annular pipette tip sealing zone 53, which protrudes from body surfaces 110 and 115, emanates from exterior surface 56 and terminates at exterior surface 57 on the body of the first pipette tip association region 50. Profile 55 of the curved surface of annular pipette tip sealing zone 53, which follows longitudinal axis 54, is defined by a radius of curvature suitable for sealingly association of the nozzle sealing zone with a pipette tip, non-limiting examples of which include 0.01 to 0.03 inches.

In some embodiments, as shown in FIG. 3, annular pipette tip sealing zone 68, which protrudes from body surfaces 120 and 125, emanates from exterior surface 66 and terminates at exterior surface 67 on the body of the second pipette tip association region 90. Profile 65 of the curved surface of annular pipette tip sealing zone 68, which follows longitudinal axis 54, is defined by a radius of curvature suitable for sealingly association of the nozzle sealing zone with a pipette tip, non-limiting examples of which include 0.01 to 0.03 inches.

In some embodiments, as shown in FIG. 3, annular pipette tip sealing zone 81, which protrudes from body surfaces 130 and 135, emanates from exterior surface 84 and terminates at exterior surface 86 on the body of the third pipette tip association region 100. Profile 80 of the curved surface of annular pipette tip sealing zone 81, which follows longitudinal axis 54, is defined by a radius of curvature suitable for sealingly association of the nozzle sealing zone with a pipette tip, non-limiting examples of which include 0.01 to 0.03 inches.

Sometimes the circumference (e.g., mean circumference, maximum circumference) or diameter (mean diameter or maximum diameter) of an annular pipette tip sealing zone is larger than the circumference or diameter of adjacent body sections of the distal region. In some embodiments a pipette tip association member comprises 1, 2, 3 or 4 annular pipette tip sealing zones. In some embodiments a first, second and third pipette tip association member comprise an annular pipette tip sealing zone (e.g., an annular pipette tip sealing zone protruding from the exterior surface of the body). In some embodiments, one but not both of the first pipette tip association member and the second pipette tip association member comprise an annular pipette tip sealing zone protruding from the exterior surface of the body. Sometimes a first pipette tip association member comprises an annular pipette tip sealing zone protruding from the exterior surface of the body and a second and/or third pipette tip association member does not comprise a pipette tip sealing zone protruding from the exterior surface of the body. Sometimes a second pipette tip association member comprises an annular pipette tip sealing zone protruding from the exterior surface of the body and a first and/or third pipette tip association member does not comprise a pipette tip sealing zone protruding from the exterior surface of the body. Sometimes a third pipette tip association member comprises an annular pipette tip sealing zone protruding from the exterior surface of the body and a first and/or third pipette tip association member does not comprise a pipette tip sealing zone protruding from the exterior surface of the body. Sometimes a first pipette tip association member comprises a first annular pipette tip sealing zone 53 and an additional annular pipette tip sealing zone 58. Sometimes a second pipette tip association member comprises a second annular pipette tip sealing zone 68 and an additional pipette tip sealing zone 76. Sometimes a third pipette tip association member comprises third annular pipette tip sealing zones 81, an additional pipette tip sealing zone 28 and a supplementary annular pipette tip sealing zone 78.

In some embodiments an annular pipette tip sealing zone (e.g., a first, second or third annular pipette tip sealing zone) is located at a position about equidistant from a distal boundary and a proximal boundary of a pipette tip association member. In some embodiments an annular pipette tip sealing zone (e.g., a first, second or third annular pipette tip sealing zone) is not located at a distal or proximal boundary of a pipette tip association member. Sometimes a first pipette tip association member comprises a first annular pipette tip sealing zone located at about 0.16 to about 0.36 inches from a distal boundary of the first pipette tip association member. Sometimes a first pipette tip association member comprises a first annular pipette tip sealing zone located at about 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35 or about 0.36 inches from a distal boundary of the first pipette tip association member (e.g., as measured from the vertical center of the annular pipette tip sealing zone to the distal boundary). Sometimes a second pipette tip association member comprises a second annular pipette tip sealing zone located at about 0.05 to about 0.18 inches from a distal boundary of the second pipette tip association member. Sometimes a second pipette tip association member comprises a second annular pipette tip sealing zone located at about 0.05, 0.06, 0.07, 0.08, 0.09, 0.10, 0.11, 0.12, 0.13, 0.14, 0.15, 0.16, 0.17 or about 0.18 inches from a distal boundary of the second pipette tip association member (e.g., as measured from the vertical center of the annular pipette tip sealing zone to the distal boundary). Sometimes a third pipette tip association member comprises a third annular pipette tip sealing zone located at about 0.10 to about 0.26 inches from a distal boundary of a third pipette tip association member. Sometimes a third pipette tip association member comprises a third annular pipette tip sealing zone located at about 0.10, 0.11, 0.12, 0.13, 0.14, 0.15, 0.16, 0.17, 0.18, 0.19, 0.20, 0.21, 0.22, 0.23, 0.24, 0.25 or about 0.26 inches from a distal boundary of the third pipette tip association member (e.g., as measured from the vertical center of the annular pipette tip sealing zone to the distal boundary).

In some embodiments an annular pipette tip sealing zone protruding from the exterior surface of the body is molded with the body. In some cases, an annular pipette tip sealing zone and the body of a nozzle (e.g., the distal region or the distal region and the proximal region) are molded as a single piece derived from the same mold and/or are made of the same material. For example, in some cases an annular pipette tip sealing zone and the body of a pipette tip association member are molded as a single piece derived from the same mold and/or are made of the same material.

In some embodiments an annular pipette tip sealing zone protruding from the exterior surface of the body is a separate entity from the body (e.g., nozzle body, body of distal region or pipette tip association member). In some cases an annular pipette tip sealing zone protruding from the exterior surface of the body is made of a different material than that used to fabricate a body. Sometimes an annular pipette tip sealing zone protruding from the exterior surface is joined to the body. In some embodiments the annular pipette tip sealing zone is joined to the body via an irreversible connection (e.g., adhesive), and sometimes it is joined to the body by a reversible connection (e.g., the sealing zone is affixed to the body by friction, snap fit or elastic forces). In some embodiments an annular pipette tip sealing zone sometimes is an elastomeric ring (e.g., an O-ring, washer or the like).

In some embodiments, a pipette tip association member comprises one or more additional annular pipette tip sealing zones (e.g., 58, 76 and 28 in FIG. 3). An additional annular pipette tip sealing zone sometimes comprises a protruding curved surface (e.g., a convex curved surface with respect to the exterior surface of the body of the pipette tip association member). In some embodiments an additional annular pipette tip sealing zone is disposed at a distal boundary of a pipette tip association member. In some embodiments a pipette tip association member comprises 1, 2, 3 or 4 additional annular pipette tip sealing zones. Sometimes a first pipette tip association member 50 comprises an additional annular pipette tip sealing zone 58. In some cases a first pipette tip association member 50 comprises an additional annular pipette tip sealing zone 58 located at about the distal boundary of a first pipette tip association member. In some embodiments the additional annular pipette tip sealing zone 58 comprises a proximal boundary (e.g., at about 61) and a distal boundary (e.g., at about 63). Sometimes a second pipette tip association member comprises an additional annular pipette tip sealing zone 76. In some cases a second pipette tip association member 90 comprises an additional annular pipette tip sealing zone 76 located at about the distal boundary of a second pipette tip association member. In some embodiments the additional annular pipette tip sealing zone 76 comprises a proximal boundary (e.g., at about 71) and a distal boundary (e.g., at about 73). In some embodiments a third pipette tip association member 100 comprises an additional annular pipette tip sealing zone 28. In some cases a third pipette tip association member 100 comprises an additional annular pipette tip sealing zone 28 located at about the distal boundary of a third pipette tip association member. In some embodiments the additional annular pipette tip sealing zone 28 comprises a proximal boundary (e.g., at about 87) and a distal boundary (e.g., at about 88 or 20). In some embodiments, as shown in FIG. 3, additional annular pipette tip sealing zone 28, which protrudes from body surfaces 135 and the distal terminus 20, emanates from exterior surface 87 and terminates at exterior surface 88 on the body of the third pipette tip association region 100. Profile 85 of the curved surface of additional annular pipette tip sealing zone 28, which follows longitudinal axis 54, is defined by a radius of curvature suitable for sealingly association of the nozzle sealing zone with a pipette tip, non-limiting examples of which include 0.01 to 0.03 inches.

In some embodiments an additional annular pipette tip sealing zone (e.g., the profile of the exterior surface of a nozzle at an additional annular pipette tip sealing zone) comprises a suitable shape, non-limiting examples of which include smooth, tapered, stepped, curved, compound curved, ridged, the like or a combination thereof. An additional annular pipette tip sealing zone sometimes is stepped. In some embodiments an additional annular pipette tip sealing zone comprises a curved surface. Sometimes a curved additional annular pipette tip sealing zone is a concave curved surface with respect to the exterior surface of the body of the pipette tip association member. Sometimes a curved additional annular pipette tip sealing zone is a convex curved surface with respect to the exterior surface of the body of the pipette tip association member. A curved surface generally accommodates a change in cross sectional diameter between two portions of a distal region. In some embodiments an additional annular pipette tip sealing zone comprises or is defined by a compound curved surface (e.g., two or more curved surfaces). Sometimes a compound curved surface comprises a first region of curvature defined by a first radius of curvature and a second region of curvature defined by a second radius of curvature.

For example, in some embodiments an additional annular pipette sealing zone 58 comprises a compound curved surface with a first curved surface emanating from a proximal point 60 and terminating at a distal point 62 and a second curved surface emanating from a proximal point 62 and terminating at a distal point 63. In certain embodiments profile 60 of additional pipette tip sealing zone 58, which follows longitudinal axis 54, can be defined by a compound curve. Sometimes an additional annular pipette sealing zone 58 comprises a first region of curvature (e.g., defined between 60 and 62) comprising a first radius of curvature and/or a second region of curvature (e.g., defined between 62 and 63) comprising a second radius of curvature. In some embodiments an additional annular pipette sealing zone 76 comprises a compound curved surface with a first curved surface emanating from a proximal point 71 and terminating at a distal point 72 and a second curved surface emanating from a proximal point 72 and terminating at a distal point 73. In certain embodiments profile 70 of additional pipette tip sealing zone 76, which follows longitudinal axis 54, can be defined by a compound curve. Sometimes an additional annular pipette sealing zone 76 comprises a first region of curvature (e.g., defined between 71 and 72) comprising a first radius of curvature and/or a second region of curvature (e.g., defined between 72 and 73) comprising a second radius of curvature. In some embodiments an additional annular pipette sealing zone 28 comprises a compound curved surface with a first curved surface emanating from a proximal point 87 and terminating at a distal point 88 and a second curved surface emanating from a proximal point 88 and terminating at a distal point 20. In certain embodiments profile 85 of additional pipette tip sealing zone 28, which follows longitudinal axis 54, can be defined by a compound curve. Sometimes an additional annular pipette sealing zone 28 comprises a first region of curvature (e.g., defined between 87 and 88) comprising a first radius of curvature and/or a second region of curvature (e.g., defined between 88 and 20) comprising a second radius of curvature. In some cases a first radius of curvature is different than a second radius of curvature. In some cases a first radius of curvature is greater than a second radius of curvature.

The radius of curvature for a curved additional annular pipette tip sealing zone surface is any suitable radius for operation of a nozzle with an ejection plate and pipette tip, for example, and non-limiting examples of a radius of curvature of a curved additional annular pipette tip sealing zone surface include 0.01 to about 0.04 inches. In some embodiments an additional annular pipette tip sealing zone has a cross sectional diameter on its most proximal boundary that is equal to the cross section of the most distal boundary of a pipette tip association member where the pipette tip association member is located adjacent and proximal to the additional annular pipette tip sealing zone. In some embodiments an additional annular pipette tip sealing zone has a cross sectional diameter on its most proximal boundary that is equal to the cross sectional diameter of the distal portion of the nozzle body located proximal and adjacent to the additional annular pipette tip sealing zone. In some embodiments an additional annular pipette tip sealing zone has a cross sectional diameter on its most distal boundary that is equal to the cross sectional diameter of the most proximal boundary of a transition region located distal and adjacent to the additional annular pipette tip sealing zone.

In some embodiments a third pipette tip association member comprises a supplementary annular pipette tip sealing zone. A supplementary annular pipette tip sealing zone sometimes comprises a protruding curved surface (e.g., a convex curved surface with respect to the exterior surface of the body of the pipette tip association member). In some embodiments a supplementary additional annular pipette tip sealing zone is disposed at or near the proximal boundary of a third pipette tip association member. Sometimes a supplementary annular pipette tip sealing zone comprises a diameter or circumference larger than adjacent body regions. In some embodiments the maximum diameter or circumference of a supplementary annular pipette tip sealing zone is larger than a third pipette tip sealing zone or an additional annular pipette tip sealing zone located on a third pipette tip association member. In some embodiments, as shown in FIG. 3, supplementary annular pipette tip sealing zone 78, which protrudes from body surfaces 77 and 130, emanates from exterior surface 82 and terminates at exterior surface 83 on the body of the third pipette tip association region 100. Profile 75 of the curved surface of supplementary annular pipette tip sealing zone 78, which follows longitudinal axis 54, is defined by a radius of curvature suitable for sealingly association of the nozzle sealing zone with a pipette tip, non-limiting examples of which include about 0.01 to about 0.03 inches.

Transition

In some embodiments a pipette tip association member transitions to another pipette tip association member. In some cases a transition region is located on the exterior surface of a nozzle between two pipette tip association members. For example, a transition can be located between a second pipette tip association member and a first pipette tip association member and/or between a first pipette tip association member and a third pipette tip association member. In certain embodiments an additional annular pipette tip sealing zone comprises a transition (e.g., a transition region). In some embodiments an additional annular pipette tip sealing zone comprises one, two or three transitions. Sometimes a transition allows for a change in cross sectional diameter (e.g., circumference) between two portions of a distal region (e.g., between a second pipette tip association member and a first pipette tip association member and/or between a first pipette tip association member and a third pipette tip association member). In some embodiments a transition (e.g., the profile of the exterior surface of a nozzle at a transition) comprises a suitable shape, non-limiting examples of which include smooth, tapered, stepped, curved, compound curved, ridged, the like or a combination thereof. A transition sometimes is stepped. In some embodiments a transition comprises a curved surface. Sometimes a curved transition is a concave curved surface with respect to the exterior surface of the body of the pipette tip association member. Sometimes a curved transition is a convex curved surface with respect to the exterior surface of the body of the pipette tip association member. A curved surface generally accommodates a change in cross sectional diameter between two portions of a distal region. In some embodiments a transition comprises or is defined by a compound curved surface (e.g., two or more curved surfaces). Sometimes a compound curved surface comprises a first region of curvature defined by a first radius of curvature and a second region of curvature defined by a second radius of curvature. In some embodiments a first radius of curvature is different than a second radius of curvature. The radius of curvature for a curved transition surface is any suitable radius for operation of a nozzle with an ejection plate and pipette tip, for example, and non-limiting examples of a curved transition surface radius of curvature include about 0.01 to about 0.03 inches. In some embodiments a transition has a cross sectional diameter on its most proximal boundary that is equal to the cross section of the most distal boundary of a pipette tip association member where the pipette tip association member is located adjacent and proximal to the transition. In some embodiments a transition has a cross sectional diameter on its most proximal boundary that is equal to the cross section of the most distal boundary of an annular pipette tip sealing zone where the annular pipette sealing zone is located adjacent and proximal to the transition. In some embodiments a transition has a cross sectional diameter on its most distal boundary that is equal to the cross section of the most proximal boundary of a pipette tip association member where the pipette tip association member is located adjacent and distal to the transition.

In some embodiments a first pipette tip association member comprises a transition emanating from a proximal point 63 and terminating at a distal point 64. In some embodiments a second pipette tip association member and/or a third pipette tip association member comprises a transition emanating from a proximal point 73 and terminating at a distal point 74.

Head Component

In some embodiments a head component assembly (e.g., 300) is fitted to or is capable of being fitted to a fluid delivery device. In some embodiments a head component assembly comprises a head component 350 comprising two opposing surfaces (e.g., proximal surface 301 and distal surface 302), sides between the opposing surfaces and a plurality of nozzles 10 projecting from one of the opposing surfaces (e.g., a distal surface). In some embodiments each of the nozzles are integrated with the distal opposing surface of a head component from which the nozzles project. In some embodiments the head component and the nozzles are separate components. In some cases, a head component comprises one or more nozzles that are reversibly associated (e.g., connected, attached) to a head component. In some embodiments a head component comprises 96 or 384 nozzles. In some embodiments, nozzles are arranged in an array on a surface of a head component (e.g., an 8×12 array, a 16×24 array). Sometimes nozzles in an 8×12 array are arranged at a distance of 9 mm (center point to center point) from each other and nozzles in a 16×24 array are arranged at a distance of 4.5 mm from each other (center point to center point). In some embodiments nozzles that are attached to a head component are capable of reversibly associating with a pipette tip comprising sealing zones of substantially different diameters.

In some embodiments a head component comprises multiple bores 310, each of which bores terminate at each of the opposing surfaces of a head component. In certain embodiments, the number of bores 310 is equal to the number of nozzles attached to a head component. For example a head component comprising an 8×12 array of nozzles comprises 96 nozzles and 96 bores. A bore (e.g., 310) is configured, in part, for air displacement and are often contiguous and aligned with a bore 5 of a nozzle. In some embodiments bores terminate at a distal surface of a head component. Sometimes bores 310 comprise a connector receiving zone 311 where the bore terminates at the distal surface of a head component. A connector receiving zone sometimes is configured to mate with (i.e., connect to) a connector of a nozzle. In some embodiments a connector receiving zone is threaded. In some embodiments the diameter of a connector receiving zone is significantly larger than the diameter of a bore 310. In some embodiments a proximal aperture of a nozzle bore is concentric with a distal aperture of a head component bore 310.

In some embodiments a head component comprises two or more bores relatively larger than bores 310, each of which relatively larger bores terminate at each of the opposing surfaces, and each of which bores is configured to receive an ejection bar (e.g., 320, an ejection rod) of a fluid delivery device. In some embodiments an ejection bar is slidably mounted to a head component. In some embodiments two or more ejection rods are connected to an ejection plate and downward movement of the one or more ejection bars results in downward movement of an ejection plate relative to a head component and nozzles.

Ejection Plates

In some embodiments a head component assembly comprises one or more ejection plates. In some embodiments an ejection plate is reversibly mounted (e.g., attached) to a head component assembly and sometimes is configured for tool-free mounting to the head component assembly. In certain embodiments the head component and an ejection plate are separate components. In some embodiments an ejection plate is configured to eject pipette tips from a head component assembly. Sometimes two or more ejection plates are configured to eject pipette tips of different sizes (e.g., different volume capacities, sealing zones of substantially different diameters). In some embodiments a second ejection plate is attached to or is configured to attach to a head component or head component assembly of a fluid delivery device. In some embodiments a head component assembly comprises a second ejection plate, a first ejection plate configured to attach to the head component assembly without removal of the second ejection plate, and the first ejection plate is configured to eject pipette tips of a different size. In some embodiments a head component assembly comprises a second ejection plate, a first ejection plate and a third ejection plate configured to attach to the head component assembly without removal of the second or first ejection plates, and the third ejection plate is configured to eject pipette tips of a different size. In some embodiments a second ejection plate is located nearest to the head component. In some embodiments a first ejection plate is located distal to the second ejection plate. The term "distal" as used herein means farther away from the head component. In some embodiments a third ejection pate is located distal to the second and first ejection plates and is located farthest from the head component.

In some embodiments an ejection plate comprises a plate member 488 comprising two opposing plate member surfaces (e.g., a proximal surface 412 and a distal surface 411) and an array of circular bores 490, each of the bores terminating at each of the opposing plate member surfaces. The surface of a plate member is often substantially flat and the proximal and distal surfaces are often substantially parallel. Although a plate member surface often is substantially flat, the surface can comprise ridges, ribs and/or grooves that sometimes are configured to add strength and rigidity to an ejection plate. In some embodiments each of the opposing plate member surfaces is substantially a quadrilateral comprising two opposing longer length sides 416 and two opposing shorter length sides 417. Sometimes an ejection plate comprises a standard 8×12 array of 96 bores where the center point of each bore is located 9 mm apart. Sometimes an ejection plate comprises a standard 16×24 array of 384 bores where the center point of each bore is located 4.5 mm apart. In certain embodiments a bore 490 on an ejection plate comprises an inside diameter slightly larger than the maximum diameter of a pipette tip association member (e.g., a first, second or third pipette tip association member) or sealing zone of a pipette tip association member on a nozzle. For example sometimes a second ejection plate comprises a bore with an inside diameter slightly larger than the maximum diameter of a first pipette tip association member or a sealing zone of a first pipette tip association member. Sometimes a first ejection plate, different than a second ejection plate, comprises a bore with an inside diameter slightly larger than the maximum diameter of a second pipette tip association member or sealing zone of a second pipette tip association member, but smaller than the maximum diameter of a first pipette tip association member or sealing zone of a first pipette tip association member. Sometimes a third ejection plate, different than a second or first ejection plate, comprises a bore with an inside diameter slightly larger than the maximum diameter of a third pipette tip association member or sealing zone of a third pipette tip association member, but smaller than the maximum diameter of a second pipette tip association member or a sealing zone of a second pipette tip association member. In some embodiments the terminus of the bores at the distal surface of a second ejection plate (e.g., 360) have a diameter greater than the diameter at the terminus of the bores at the distal surface of a first ejection plate (e.g., 400). In some embodiments the terminus of the bores at the distal surface of a first ejection plate (e.g., 400) have a diameter greater than the diameter at the terminus of the bores at the distal surface of a third ejection plate.

In some cases the surface of a bore (e.g., 490) extending from one plate member surface to the other plate member surface is not vertical (e.g., not linear). Sometimes a bore comprises a counter bore. Sometimes a counter-bore is concentric with the bore. In some embodiments a bore of an ejection plate (e.g., 490) comprises a bore surface member (e.g., 493 and 480 in FIG. 35). Sometimes a bore surface member comprises a counter bore. In some embodiments a bore surface member is on the surface of a bore located on the proximal surface of a plate member. Sometimes a bore surface member is configured to seat the proximal surface of an ejection plate to the transition region of a nozzle. In certain embodiments the diameter of proximal portion of bore surface member 480 and/or the diameter of the aperture of bore 490 located at the proximal surface of plate member 488 is larger than the diameter of the aperture of bore 490 at the distal surface of plate member 488. In some embodiments a bore 490 and/or a bore surface member is configured to fit around a sealing zone of a nozzle projecting from a head component of the fluid delivery device. Sometimes a bore surface member comprises regions of different diameters. In some embodiments a bore surface member comprises a first vertical member (e.g., 496) extending from, and substantially perpendicular to the proximal surface of a plate member, and a second vertical member (e.g., 497) extending from, and substantially perpendicular to proximal surface of a plate member, which first vertical member defines a cylindrical void having a diameter larger than the diameter of a cylindrical void defined by the second vertical member. In some embodiments a bore surface member comprises an angled surface (e.g. 480). Sometimes an angled surface comprises a change (e.g., a decrease) in diameter of a bore 490 from the proximal surface to the distal surface of a plate member. Sometimes the angled surface is disposed at an angle greater than about 90 degrees and less than about 180 degrees with respect to the 180 degree vertical axis 105 which is perpendicular to the plate member surface (e.g., the plate member surface is at 90 degrees). In some embodiments the angle is about 90 degrees at the proximal surface of the plate and gradually changes to about 180 degree at the aperture of the bore located at the distal surface of the plate with respect to vertical axis 55. In some embodiments a bore is bowl shaped (e.g., a conical cup shape) as viewed from the proximal surface of a plate member.

In some embodiments an ejection plate comprises a riser extending from one of the plate member surfaces. Sometimes an ejection plate comprises two risers (e.g., 452) located on opposing sides of an ejection plate and flanking the array of bores and each riser having an outer surface 451 and an inner surface 452. In some embodiments a riser comprises a longer length side and a shorter length side, and the longer length side of each riser is coextensive with a shorter length side of a plate member surface. In some embodiments the thickness of each riser is substantially the same as the thickness of the plate member. In some embodiments a flange (e.g., 425) extends from each of the risers, which flange comprises two opposing flange surfaces (e.g., proximal flange surface 482 and distal flange surface 483) substantially parallel to the plate member surfaces (e.g., 411 and 412). In some embodiments the thickness of each flange is substantially the same as the thickness of the plate member. Sometimes the height of riser is configured to align the upper plate member surface (e.g., bore surface member) with a transition region of a nozzle when an ejection plate is attached to a head component assembly. In some embodiments an ejection plate (e.g., a first or third ejection plate) comprises a riser (e.g., 452) and a second ejection plate comprises no riser.

In some embodiments an ejection plate does not comprise a riser. Sometimes the effect of a riser is accomplished by providing a thicker plate. For example sometimes an ejector plate does not include a riser and comprises a flange with a proximal flange surface 482 and distal flange surface 483 that are coplanar with the proximal surface and distal surface of the plate member. In some embodiments the thickness of the plate member is configured to align the bore surface member with a transition region of a nozzle when an ejection plate is attached to a head component assembly.

Figure 35:
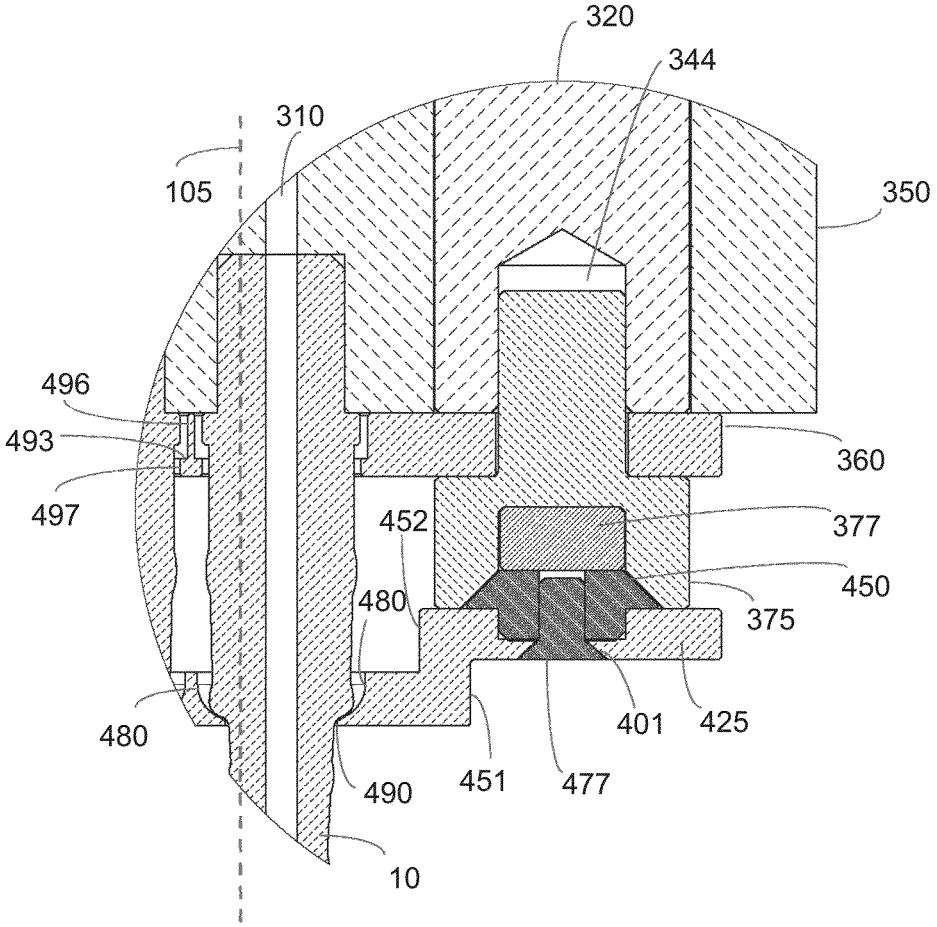
FIG. 35 shows a blow up view of an embodiment of an ejection adapter plate attachment.
Figure 36:
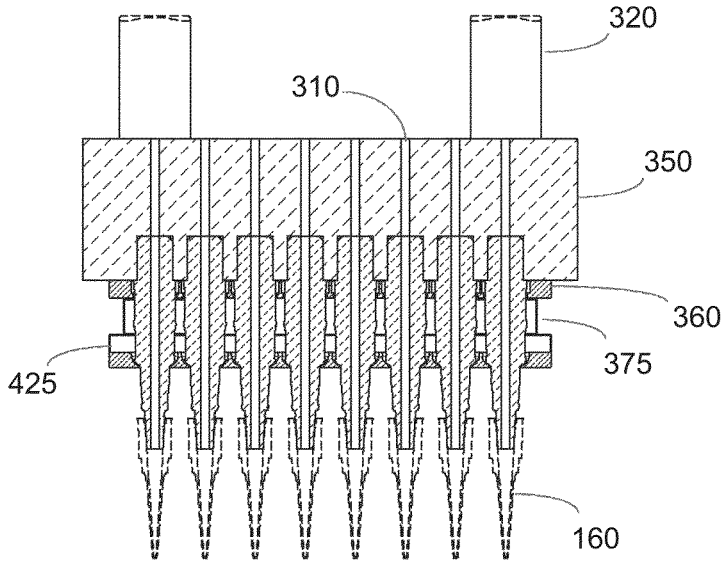
FIG. 36 shows a cross sectional narrow side view of an automated pipetting system comprising a head unit, an ejection plate, nozzles, an ejection adapter plate and small pipette tips attached to the nozzles.
Figure 37:
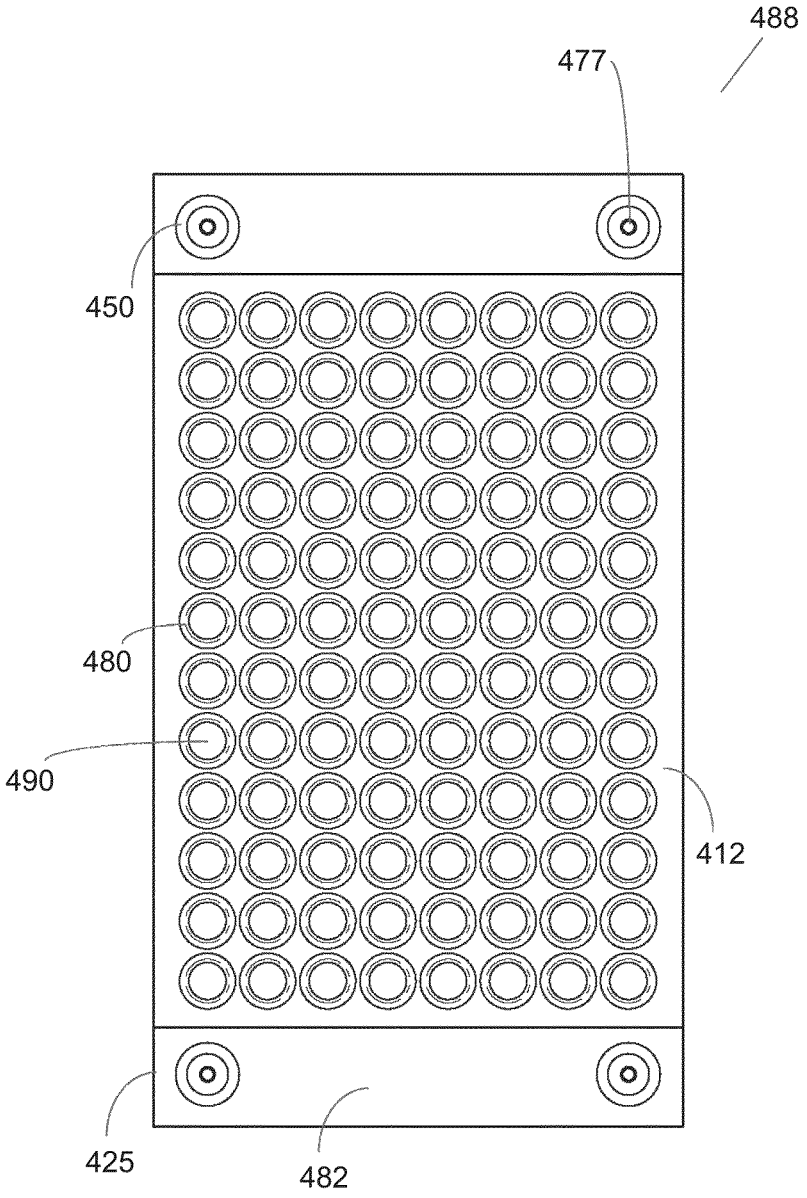
FIG. 37 shows a top view of an ejection adapter plate.
Figure 38:
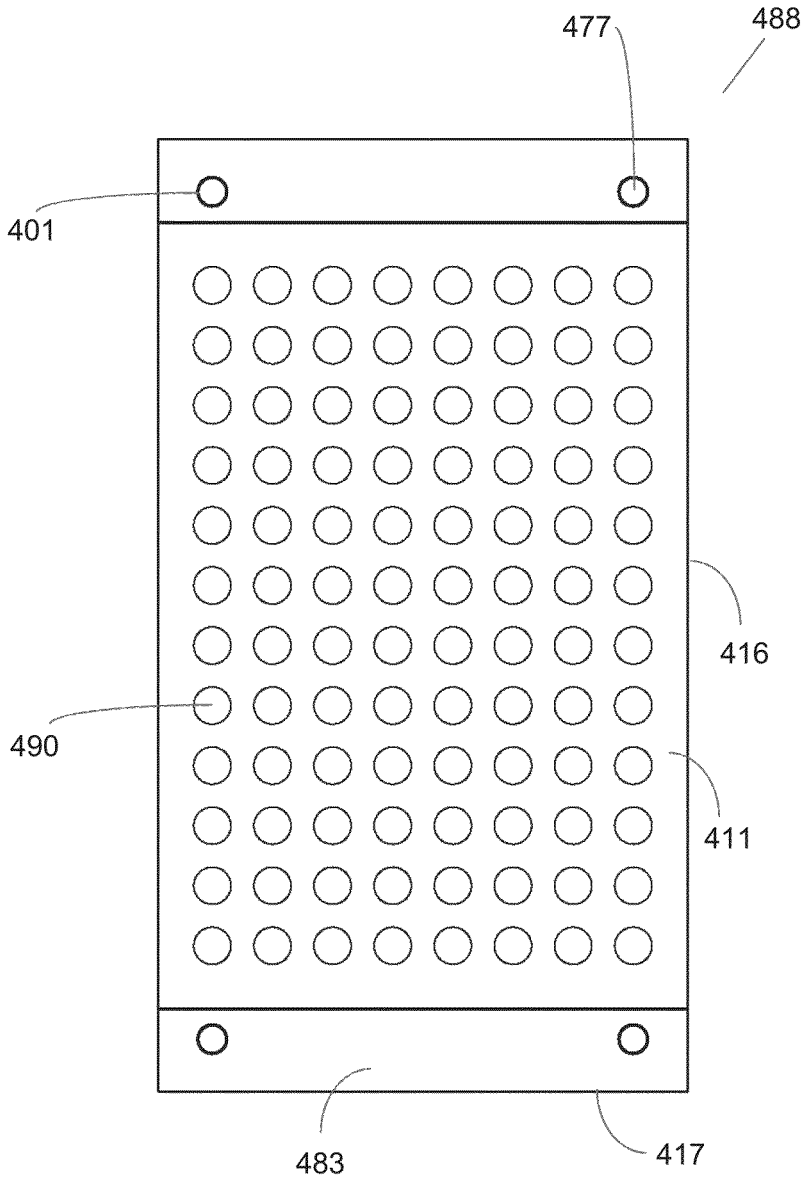
FIG. 38 shows a bottom view of an ejection adapter plate.
Figure 39:
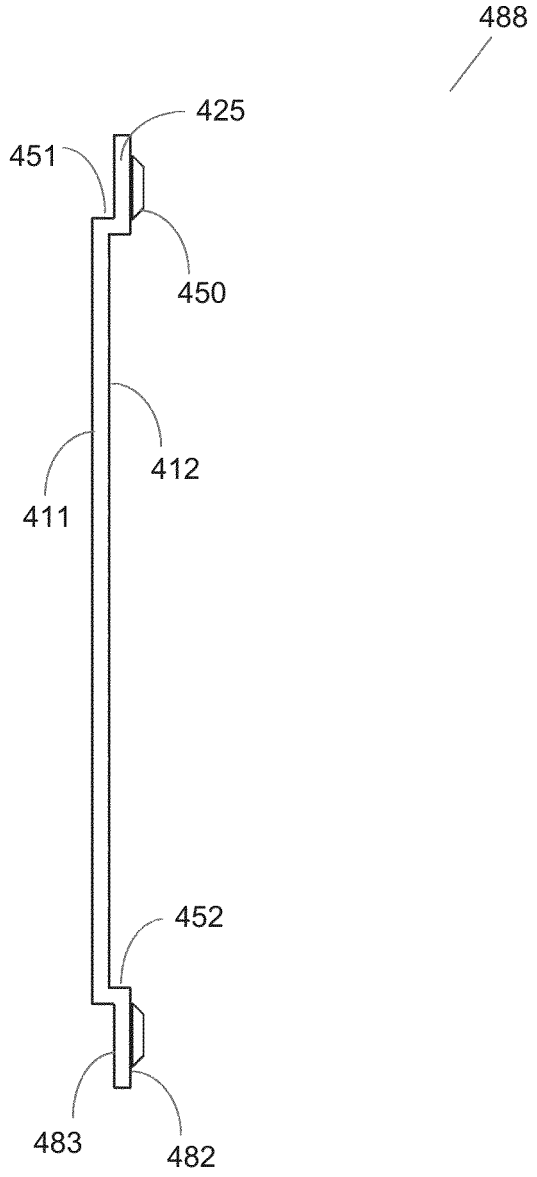
FIG. 39 shows a wide side view of an ejection adapter plate.
Figure 40:
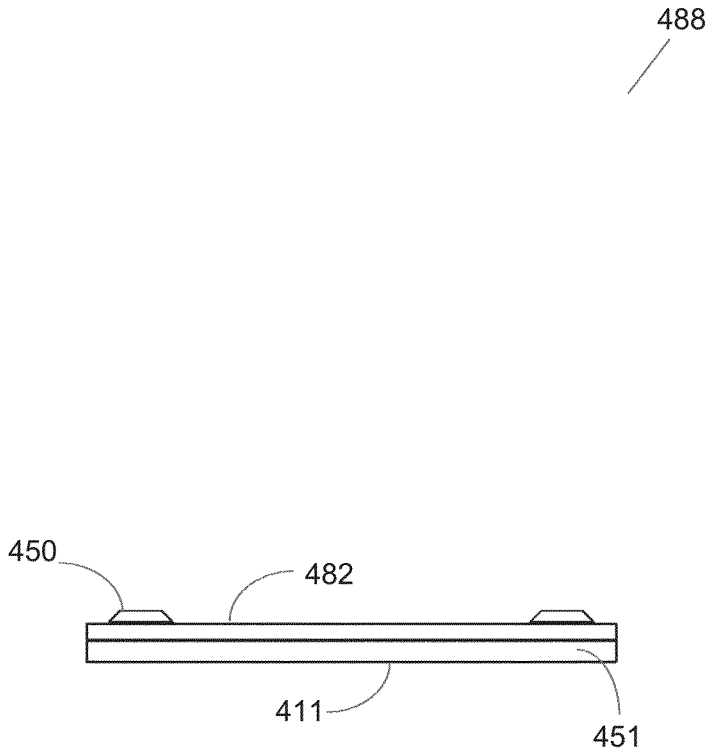
FIG. 40 shows a narrow side view of an ejection adapter plate.
Figure 41:
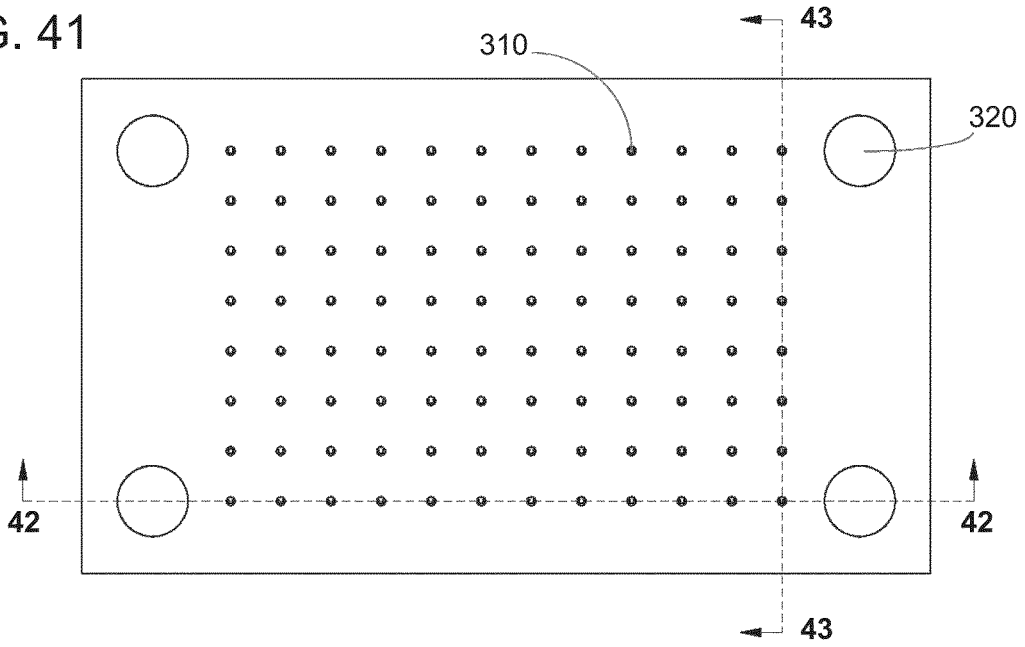
FIG. 41 shows a top view of a head unit of an automated pipetting system.
Figure 42:
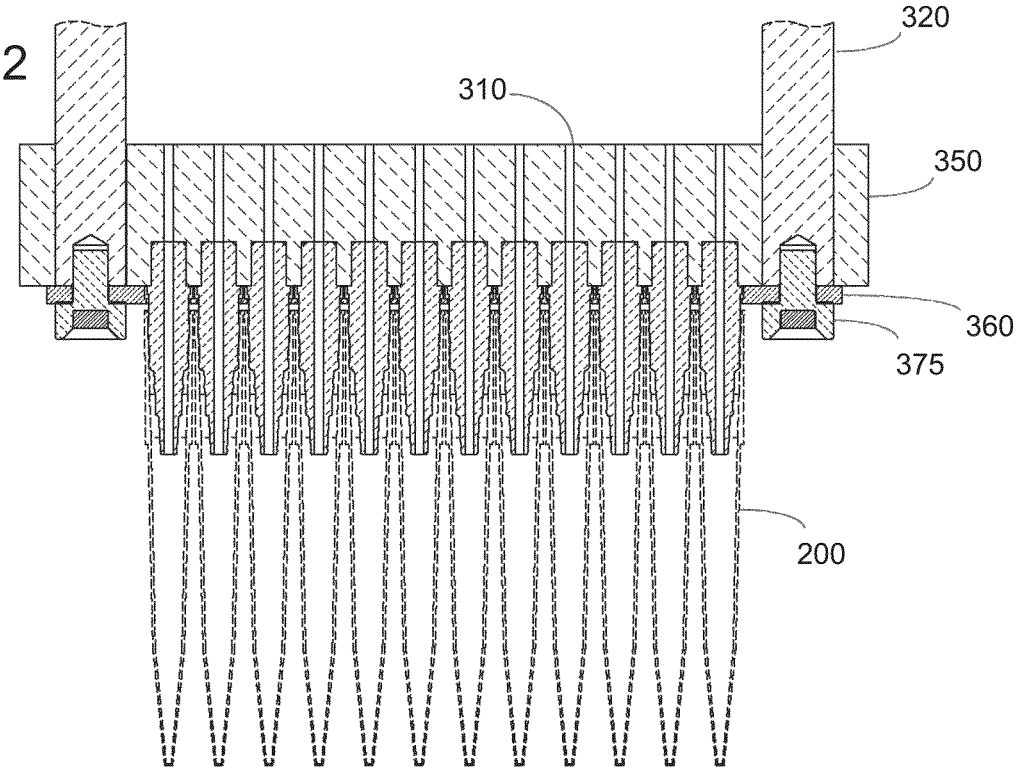
FIG. 42 shows a cross sectional wide side view of an automated pipetting system comprising a head unit, an ejection plate, nozzles, and large pipette tips attached to the nozzles.
Figure 43:
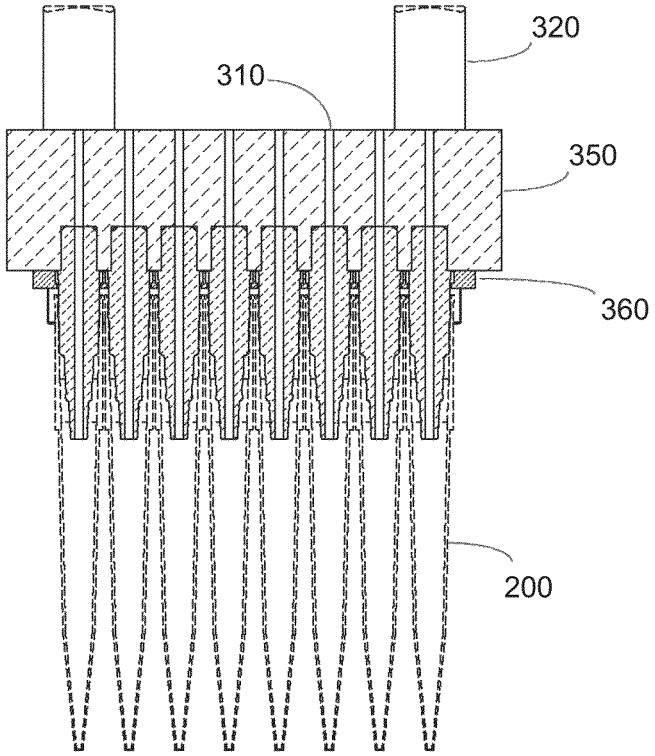
FIG. 43 shows a cross sectional narrow side view of an automated pipetting system comprising a head unit, an ejection plate, nozzles, and large pipette tips attached to the nozzles.
Figure 44:
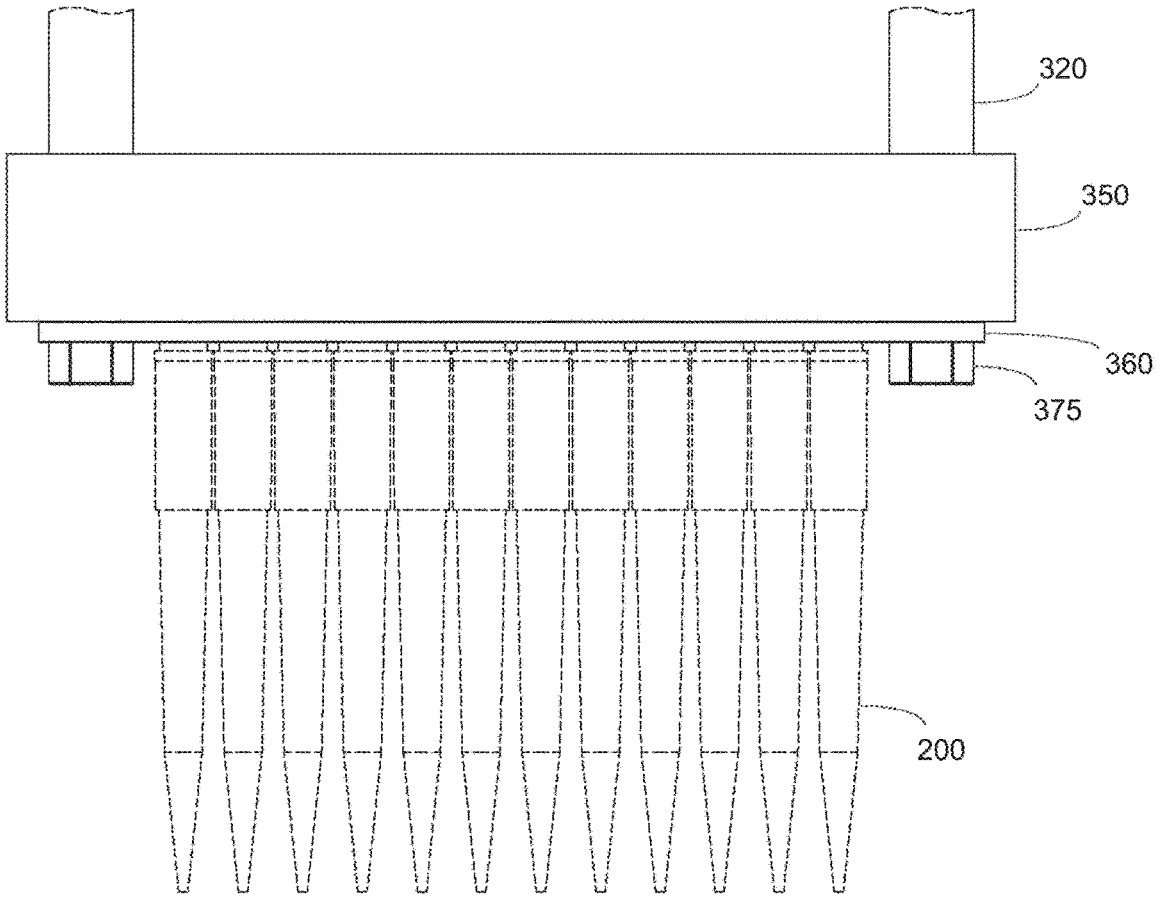
FIG. 44 shows a wide side view of an automated pipetting system comprising a head unit, an ejection plate, nozzles, and large pipette tips attached to the nozzles.
Figure 45:
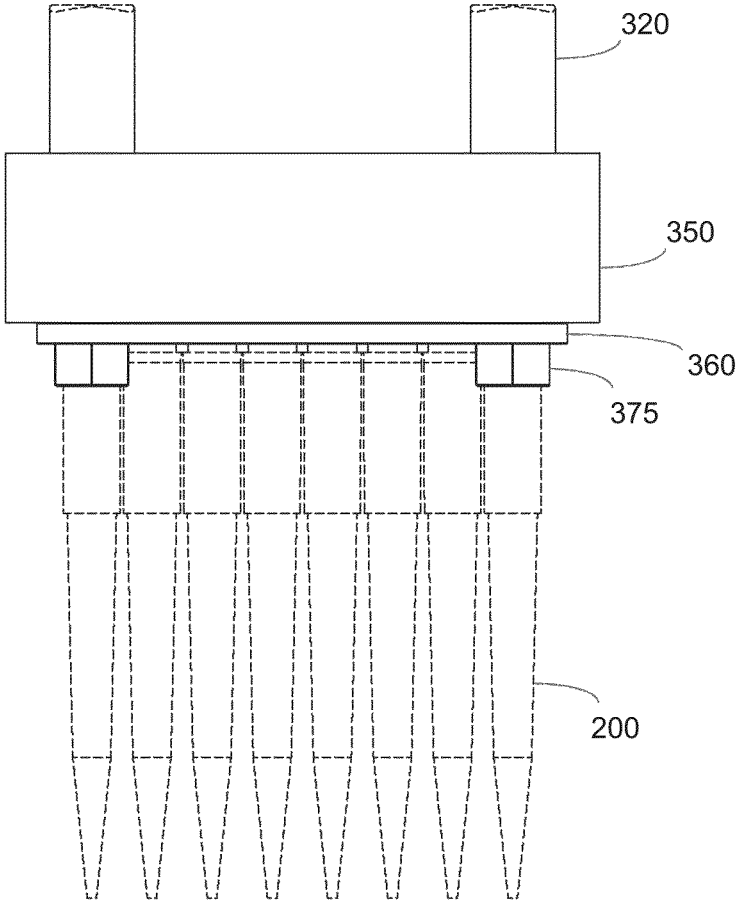
FIG. 45 shows a narrow side view of an automated pipetting system comprising a head unit, nozzles, an ejection plate and large pipette tips attached to the nozzles.
Figure 46:
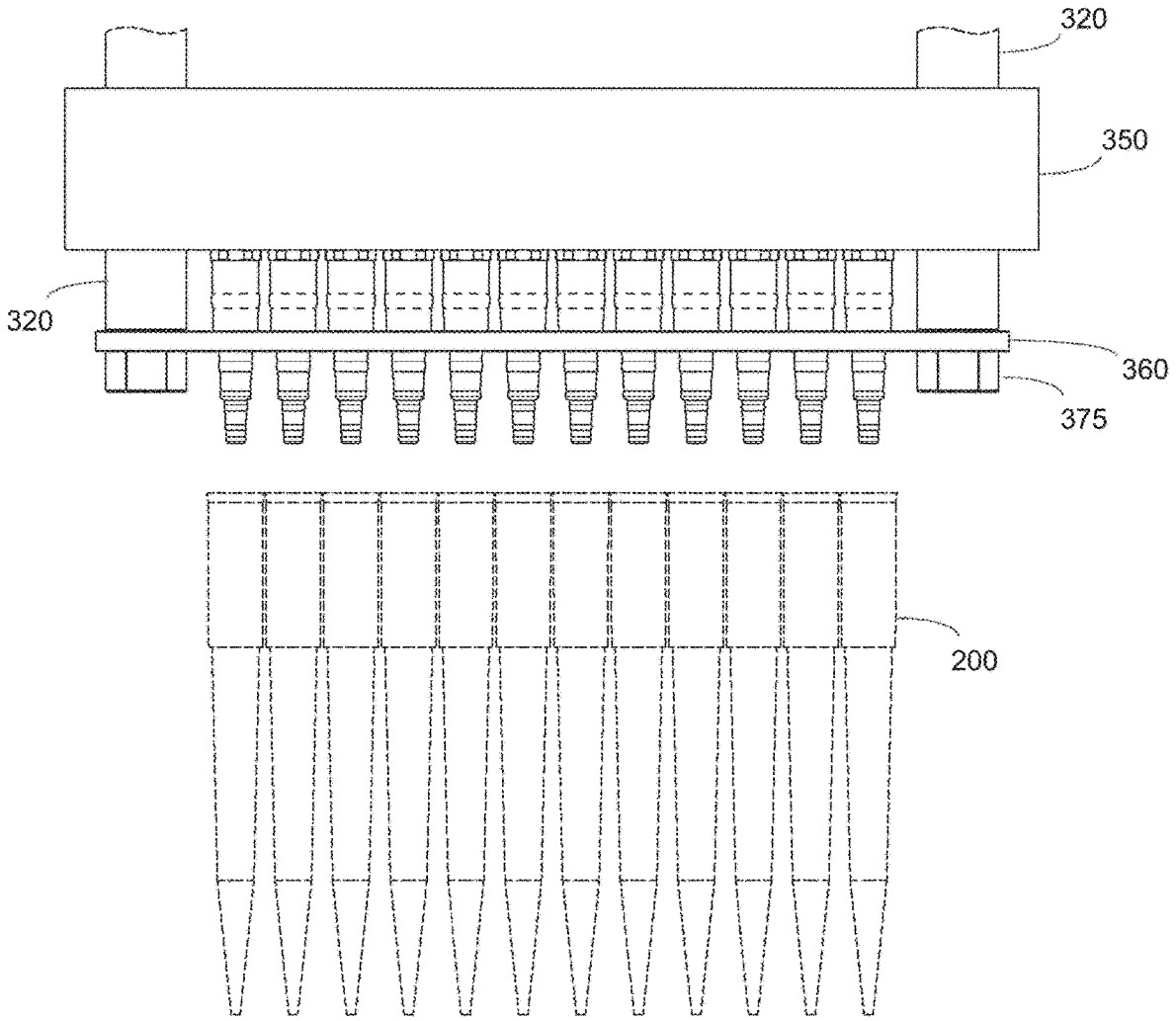
FIG. 46 shows a wide side view of an automated pipetting system comprising a head unit, an ejection plate in a down position, nozzles, and large pipette tips ejected from the nozzles.
Figure 47:
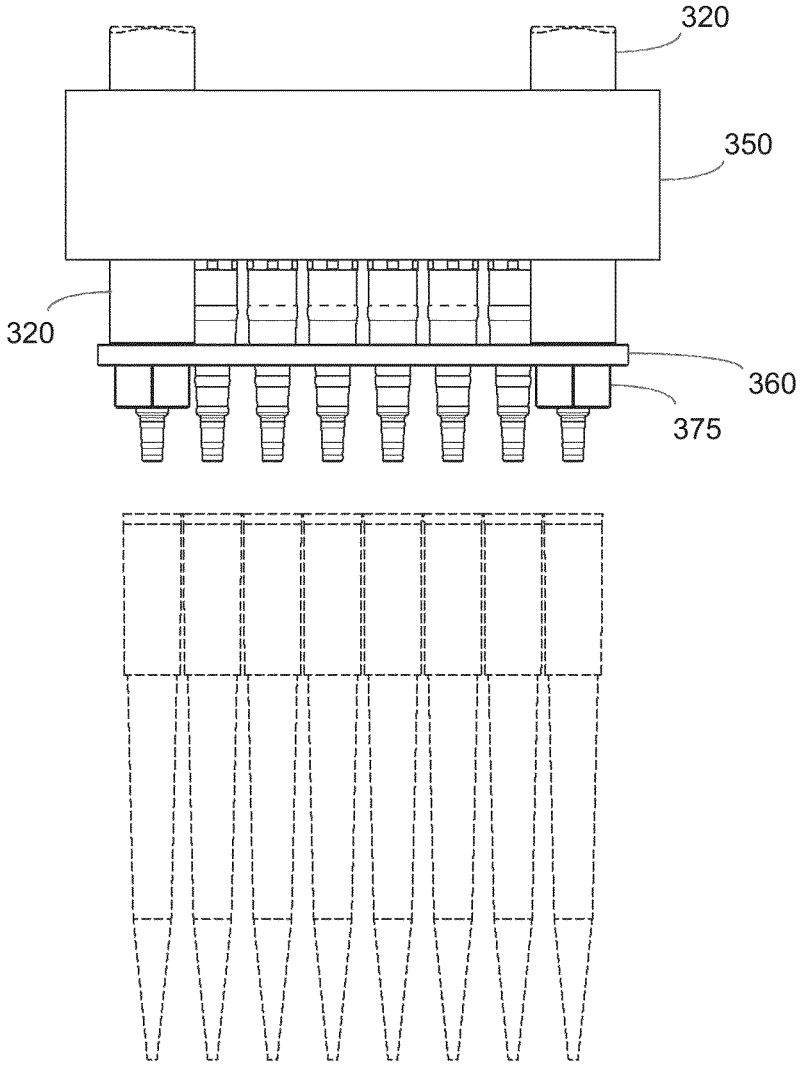
FIG. 47 shows a narrow side view of an automated pipetting system comprising a head unit, an ejection plate in a down position, nozzles, and large pipette tips ejected from the nozzles.
Figure 48:
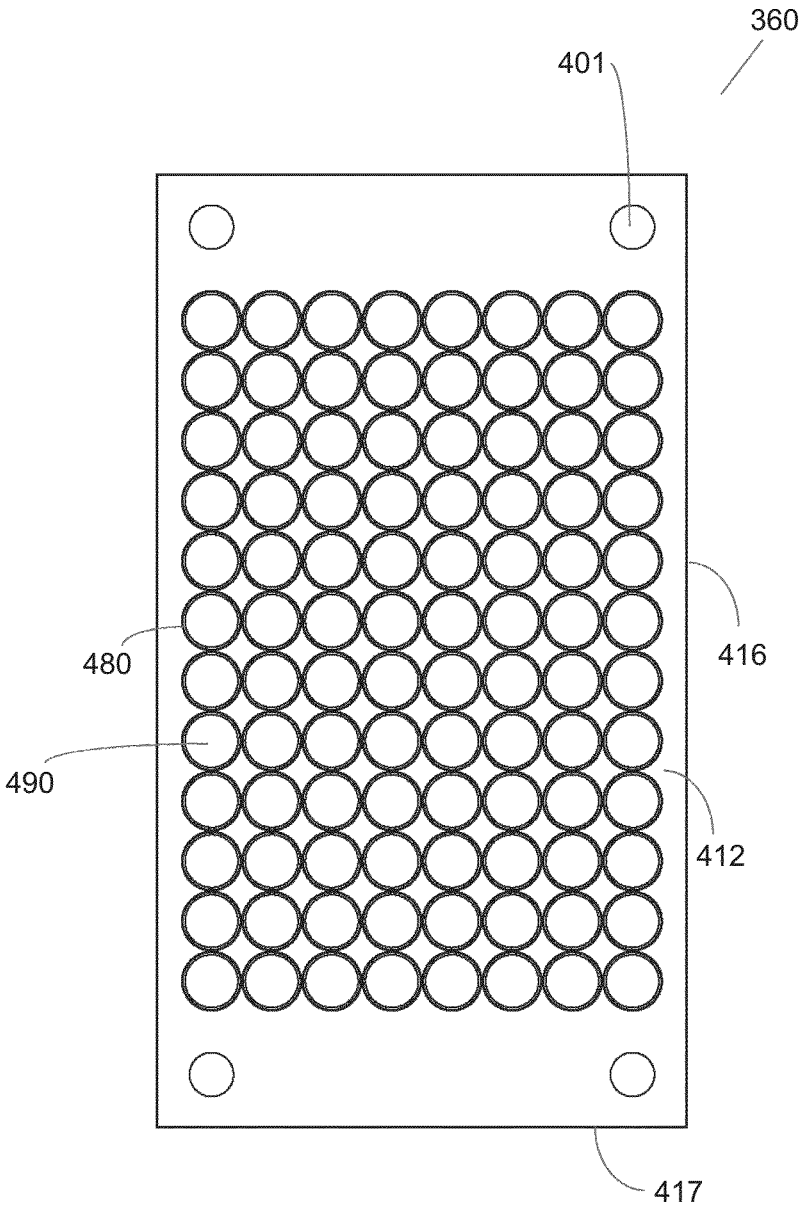
FIG. 48 shows a top view of an ejection plate.
Figure 49:
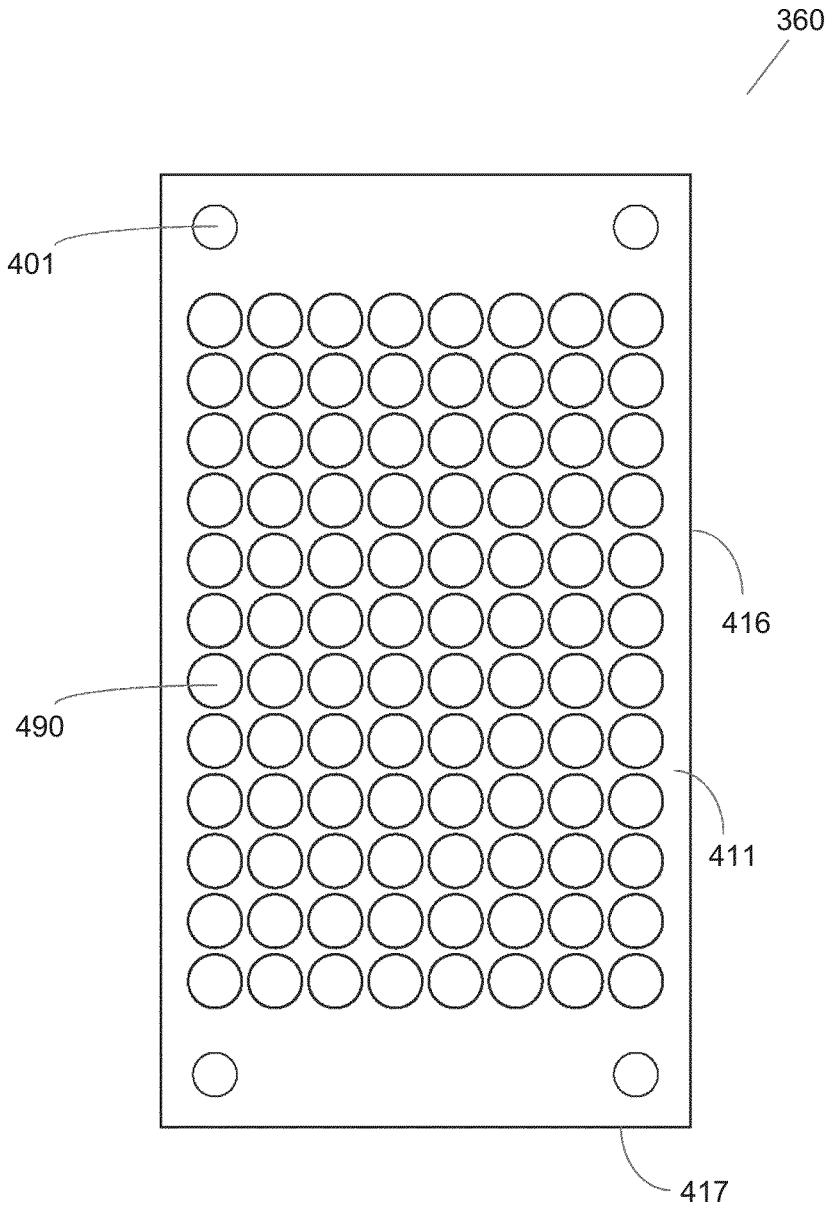
FIG. 49 shows a bottom view of an ejection plate.
Figure 50:
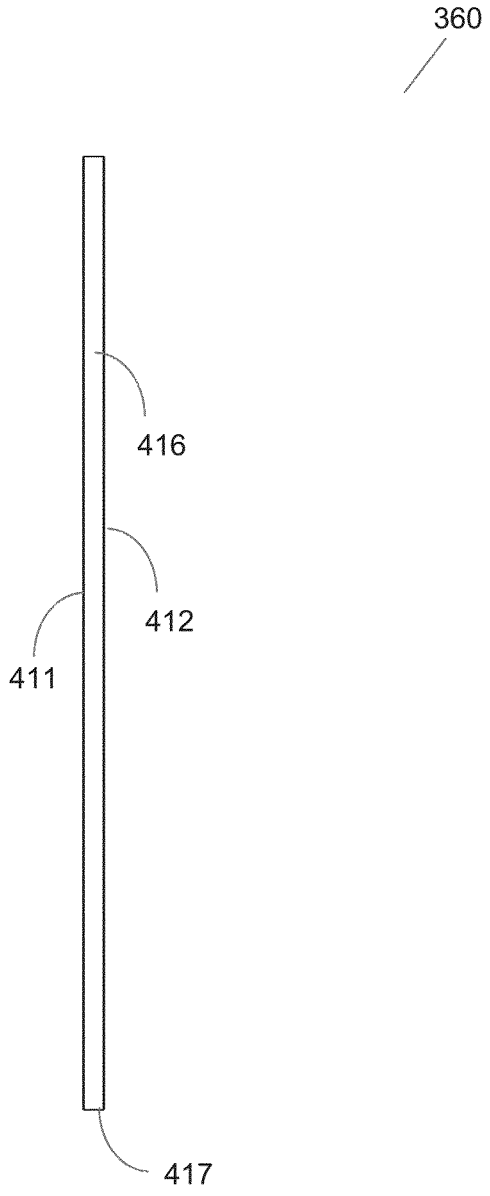
FIG. 50 shows a wide side view of an ejection plate.
Figure 51:
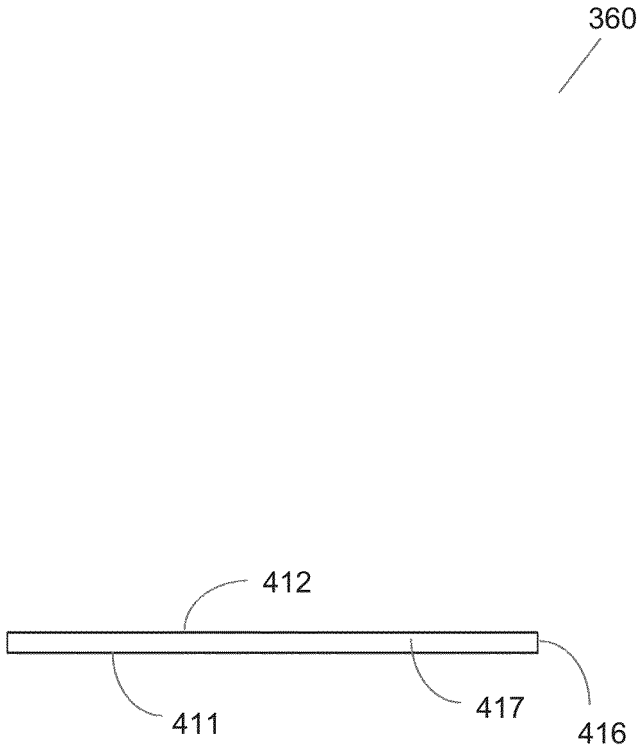
FIG. 51 shows a narrow side view of an ejection plate.

In some embodiments a head component assembly comprises an ejection plate and one or more connectors (e.g., connector 375, additional connector 377, proximal plate connector 450, distal plate connector 477, FIG. 35) in association with a plate member surface, a flange surface and/or an ejection bar. In certain embodiments a connector is reversibly attached to an ejection bar or ejection plate. In some embodiments a head component, ejection plate, and one or more connectors are separate components. Sometimes a connector (e.g., 375) is configured to effectively connect an ejection plate to an ejection bar of a fluid delivery device (e.g., a head component assembly). For example sometimes a connector is in contact with the distal surface of an ejection plate (e.g., a second ejection plate) and is configured to attach an ejection plate to an ejection bar. In some embodiments a connector (e.g., 450) comprises a frustrum-shaped surface protruding from a surface (e.g., a proximal surface) of an ejection plate and is configured to connect to a frustrum-shaped void in a connector counterpart (e.g., 375). In some embodiments a connector is configured to effectively connect an ejection plate (e.g., a second or third ejection plate) to another ejection plate (e.g., a second ejection plate) attached to a fluid delivery device (e.g., a head component assembly). In some embodiments a connector is configured to effectively connect an ejection plate (e.g., a second or third ejection plate) to another ejection plate (e.g., a second ejection plate) attached to a fluid delivery device (e.g., a head component assembly) by an association between the connector and the ejection bar. A connector can be a suitable connector, non-limiting examples of which include a nut, a bolt, a screw, a rivet, a dowel, retainer (e.g., retaining clip, cap, washer, pin), adhesive, a magnet, the like or combination thereof. A connector can be integrated with another connector, permanently adhered to another connector or reversibly affixed to another connector. In some embodiments a connector is a magnet. In certain embodiments, a connector comprises a magnet, a magnetizable metal or a magnetically attractable metal. In some embodiments one or more connectors are magnetically attracted to one another.

In some embodiments a head component assembly comprises second ejection plate, a connector 375 and optionally an additional fastener 377. Sometimes connector 375 is a bolt and is sometimes threaded into an ejection bar. In some embodiments connector 375 comprises or is connected to an additional fastener 377. In some embodiments an ejection plate (e.g., a first ejection plate) comprises a proximal plate connector and a distal plate connector. In some embodiments distal plate connector 477 is configured to anchor (e.g., hold, affix) proximal plate connector 450 to the proximal surface or proximal flange surface 482 of an ejection plate. In some cases a proximal plate connector and/or a distal plate connector pass through a bore 401 located on an ejection plate. A proximal plate connector and distal plate connector can be connected (e.g., anchored) by a suitable connector, non-limiting examples of which include a nut, a bolt, a screw, a rivet, a bushing, a dowel, retainer (e.g., retaining clip, cap, washer, pin), adhesive, a magnet, the like or combination thereof.

In some embodiments a proximal plate connector and/or distal plate connector are magnetically attracted to an additional fastener (e.g., 377) and/or to a connector 375. In some embodiments additional fastener 377 and/or connector 375 comprise a magnet and the proximal plate connector and/or distal plate connector comprise a magnetically attractable metal. In some embodiments additional fastener 377 and/or connector 375 comprise a magnetically attractable metal and the proximal plate connector and/or distal plate connector comprise a magnet. In some embodiments additional fastener 377 and/or connector 375 comprise a magnet and the proximal plate connector and/or distal plate connector comprise a magnet.

In some embodiments a magnetic connector (e.g. the proximal plate connector and/or distal plate connector) protrude from a surface of an ejection plate or are recessed within a surface (e.g., proximal surface and/or distal surface) of the ejection plate (e.g., the surface of a magnetic connector can be flush with a surface of the ejection plate).

In some embodiments a head component assembly comprises an ejection plate, a connector in association with the ejection plate, an ejection bar, and a counterpart connector in association with the ejection bar that connects to the connector in associated with the ejection plate. Sometimes the connector counterpart is positioned inside the ejection bar. A connector and counterpart connector can be any suitable connector mating, non-limiting examples of which include a nut and bolt, threaded male surface and threaded female surface, screw and cylinder (e.g., a bore), dowel and bore, cross dowel and barrel nut, pop snaps, push snaps, rivet snaps, rivet pairs, book screws, wedge and sleeve anchors, rod and lock ring, rod and lock pin, bolt and pin, rod and retaining ring, groove and bearing, magnet and magnet, magnet and metal, the like or combinations thereof.

In some embodiments an ejection plate comprises one or more connectors and a head component assembly comprising one or more counterpart connectors configured to attach (e.g., connect, reversibly attach) to the one or more connectors on the ejection plate. In some embodiments the counterpart connectors are connected to an ejection bar. In some embodiments an ejection plate comprises four connectors and a head component assembly comprises four counterpart connectors configured to attach (e.g., connect, reversibly attach) the ejection plate to the head component assembly. Sometimes an ejection plate comprises four connectors and a head component comprises four ejection bars each comprising a counterpart connector configured to attach (e.g., connect, reversibly attach) the ejection plate to the ejection bars of the head component assembly.

In some embodiments a second ejection plate comprises one or more connectors and first ejection plate comprises one or more counterpart connectors configured to attach (e.g., connect, reversibly attach) the second ejection plate to the first ejection plate. In some embodiments a second ejection plate comprises four connectors and a first ejection plate comprises four counterpart connectors configured to attach (e.g., connect, reversibly attach) the second ejection plate to the first ejection plate. Sometimes a second ejection plate comprises four connectors and a first ejection plate comprises four counterpart connectors each configured to attach (e.g., connect, reversibly attach) the second ejection plate to the first ejection plate. In certain embodiments the first ejection plate is distal to the second ejection plate. In some embodiments the second ejection plate is connected directly to the first ejection plate. In some embodiments the second ejection plate is connected indirectly to the first ejection plate. In some embodiments each connector or counterpart connector is an assembly comprising one or more connectors.

Materials

In some embodiments an ejector plate, a nozzle, an ejector bar and/or a connector are constructed from a suitable metal, metal alloy or plastic non-limiting example of which include iron, copper, tin, bronze, pewter, lead, zinc, nickel, gold, brass, chrome, zinc, silver, palladium, platinum, aluminum, titanium, stainless steel, polyethylene, polypropylene, polystyrene, polycarbonate, polyvinyl chloride, polytetrafluoroethylene, the like or combinations thereof. In some embodiments an ejector plate, a nozzle, an ejector bar and/or a connector are constructed from a substantially non-magnetizable material. In some embodiments an ejector plate, a nozzle, an ejector bar and/or a connector are constructed from a substantially magnetizable material. In some embodiments an ejector plate, an ejector bar and/or a connector comprise a magnet.

Compositions

In some embodiments a composition comprises a second ejection plate and a first ejection plate each capable of ejecting pipette tips from nozzles of a fluid delivery device having ejection rods. Sometimes the second ejection plate and the first ejection plate each comprise a plate member comprising two opposing plate member surfaces, an array of bores, each of which bores terminates at each of the opposing plate member surfaces, and connectors each in association with a surface of each of the second ejection plate and the first ejection plate. In some embodiments a composition comprises a first and first ejection plate comprising connectors configured for mounting the second ejection plate and the first ejection plate in a fluid delivery device whereby the plate member surfaces of the first ejection plate are distal to the plate member surfaces of the second ejection plate. Sometimes the second ejection plate is mounted to the first ejection plate in an orientation that positions the bores of the second ejection plate concentric with the bores of the first ejection plate.

In some embodiments a composition comprises a second ejection plate and a first ejection plate, a first ejection plate and a third ejection plate or a first, second and third ejection plate. In some embodiments a kit comprises a second ejection plate and a first ejection plate, a first ejection plate and a third ejection plate or a first, second and third ejection plate. In some embodiments a composition or kit comprises apparatus (e.g., a head component, a head component assembly or a fluid delivery device) comprising two or three different ejection plates as described herein. Sometimes a second ejection plate or a first ejection plate, but not the second ejection plate and the first ejection plate, is mounted to an apparatus (e.g., a head component, a head component assembly or a fluid delivery device). Sometimes the second ejection plate and the first ejection plate are mounted to an apparatus (e.g., a head component, a head component assembly or a fluid delivery device).

Pipette Tips

Pipette tips described herein can be of any overall geometry useful for dispensing fluids in combination with a dispensing device. Pipette tips can be of any volume useful for dispensing fluids in combination with a dispensing device non-limiting examples of which include pipette tips configured in sizes that hold from about 0 to about 5 microliters, about 0 to about 10 microliters, about 0 to about 20 microliters, about 0 to about 50 microliters, about 1 to about 100 microliters, about 1 to about 150 microliters, about 1 to about 200 microliters, about 1 to about 250, about 1 to about 300 microliters, about 1 to about 500 microliters, about 1 to about 600 microliters, about 1 to about 1000 microliters and from about 1 to about 1250 microliters. Sometimes the volume that a pipette tip can manipulate is larger than the volume designation given to a particular pipette tip. For example, a pipette tip designated as suitable to manipulate volumes up to 300 microliters, can sometimes be used to manipulate volumes up to about 1%, 2%, 3%, 5%, 10%, 15% or sometimes as much as up to about 20% larger than the designated pipette tip volume.

In general pipette tips comprise a proximal region configured to attach to a dispenser (e.g., a pipette, a nozzle) and a distal region configured for dispensing liquid. The external appearance of pipette tips may differ, and certain pipette tips can comprise a continuous tapered wall forming a central channel or tube that is roughly circular in horizontal cross section. A pipette tip can have any cross-sectional geometry that results in a tip that (i) provides suitable flow characteristics, and (ii) can be fitted to a dispenser (e.g., pipette, a nozzle), for example.

In some embodiments, a pipette tip can have (i) an overall length of about 1.10 inches to about 3.50 inches (e.g., about 1.25, 1.50, 1.75, 2.00, 2.25, 2.50, 2.75, 3.00, 3.25 inches); (ii) a fluid-emitting distal section terminus having an inner diameter of about 0.01 inches to about 0.03 inches (e.g., about 0.015, 0.020, 0.025 inches) and an outer diameter of about 0.02 to about 0.7 inches (e.g., about 0.025, 0.03, 0.04, 0.05, 0.06 inches); and (iii) a dispenser-engaging proximal section terminus having an inner diameter of about 0.10 inches to about 0.40 inches (e.g., about 0.15, 0.20, 0.25, 0.30, 0.35 inches) and an outer diameter of about 0.15 to about 0.45 inches (e.g., about 0.20, 0.25, 0.30, 0.35, 0.45 inches). In the latter embodiments, the inner diameter is less than the outer diameter.

The wall of the proximal section of a pipette tip is sometimes continuously tapered from the proximal portion, to a narrower terminus. The proximal portion generally is open and often is shaped to receive a pipette tip engagement portion of a dispensing device (e.g., a nozzle). The wall of a proximal section, in some embodiments, forms a stepped tapered surface. The angle of each taper in the proximal section is between about zero degrees to about thirty degrees from the central longitudinal vertical axis of the pipette tip (e.g., about 0, 1, 2, 3, 4, 5, 6, 7, 8, 9, 10, 11, 12, 13, 14, 15, 16, 17, 18, 19, 20, 21, 22, 23, 24, 25, 26, 27, 28, 29 or 30 degrees), in certain embodiments. A proximal section of a pipette tip may contain a filter, insert or other material.

In some embodiments, pipette tips include an annular flange (e.g., a flared lead-in surface at the end of the proximal region) at the proximal terminus of the proximal region. An annular flange can, in some cases, assist with ejection of a pipette. In some embodiments, a flange may be flared. Such a flange can provide a larger contact zone for engaging a nozzle, and can increase the probability of a sealing engagement between a nozzle not coaxially aligned with a pipette tip by guiding the axial center of the pipette tip to the axial center of the nozzle. An annular flange also can provide pipette tip rigidity in addition to facilitating dispenser alignment.

Some pipette tip embodiments can comprise one or more flexible features. In certain embodiments, a pipette tip includes a section of flexible thickness (e.g., proximal region) that sometimes also can include axially oriented alternating regions of increased thickness (e.g., axially oriented ribs or sets of ribs). In certain embodiments axially oriented ribs are alternately spaced and circumferentially spaced around the external surface of a proximal region of a pipette tip.

A nozzle often sealingly engages an inner portion of a pipette tip at a sealing zone, which generally is located a particular distance from the proximal terminus of a pipette tip. In some embodiments, a sealing zone provides a continuous contact zone for frictional and/or sealing engagement between a pipette tip and a dispenser. A sealing zone in certain embodiments is disposed a particular distance below the terminal opening of a pipette tip (e.g., the sealing zone is offset from the edge of the pipette tip). A sealing zone often is a point at which a fluid tight, frictional and/or sealing engagement occurs between a pipette tip and a nozzle. A sealing zone is axially coextensive with a region of flexible thickness and/or increased thickness (e.g., ribs) in some embodiments. In certain embodiments, a proximal region comprises a sealing zone.

As noted above, a pipette tip generally is affixed to a dispensing device by inserting a portion of the dispenser (e.g., dispenser barrel, tip or nozzle) into the proximal or receiving end of a pipette tip with a downward or axial force. Radial expansion and segmental expansion of a pipette tip can allow for a secure, fluid tight sealing engagement of a pipette tip with a nozzle.

Radial and segmental expansion properties of a pipette tip can be a result of circumferentially spaced alternating regions of thicker and thinner ribs. Sometimes the proximal region of a pipette tip comprises axially extended ribs. Axially extended ribs, which also are referred to herein as "axially oriented ribs," are longer in the direction of the pipette tip axis, where the axis extends from the center of the proximal region terminus cross section to the center of the distal region terminus cross section. Axially extended ribs are shorter in the radial, circumferential direction around the pipette tip. In certain embodiments, the longer length of axially extended ribs is parallel to the pipette tip axis. In some embodiments, the longer length of axially extended ribs is at an angle with respect to the pipette tip axis, which angle sometimes is between about zero to ten degrees from such axis. In some embodiments, a pipette tip comprises a set of axially extended ribs circumferentially spaced around the external surface of the proximal region of the pipette tip. The term "circumferentially spaced," "circumferentially configured," "circumferentially disposed" and the like as used herein, refer to axially extended ribs disposed around a circumference of the proximal region of a pipette tip.

Ribs on a pipette tip have a particular thickness (e.g., height measured from the exterior surface of the pipette tip proximal region) and a particular width. In certain embodiments, the maximum thickness of a rib is about 0.060 inches, and sometimes the maximum thickness of a rib is about 0.037 inches to about 0.060 inches (e.g., about 0.038, 0.039, 0.040, 0.041, 0.042, 0.043, 0.044, 0.045, 0.046, 0.047, 0.048, 0.049, 0.050, 0.051, 0.052, 0.053, 0.054, 0.055, 0.056, 0.057, 0.058, 0.059 inches thick). Sometimes the maximum thickness of a rib is about 0.016 inches to about 0.027 inches thick (e.g., about 0.017, 0.018, 0.019, 0.020, 0.021, 0.022, 0.023, 0.024, 0.025, 0.026 inches thick), and sometimes the maximum thickness of a rib is about 0.011 to about 0.021 inches thick (e.g., about 0.012, 0.013, 0.014, 0.015, 0.016, 0.017, 0.018, 0.019, 0.020 inches thick).

Many of the features of pipette tips described herein are shared between pipette tips of different sizes.

EXAMPLES

The following Examples are provided for illustration only and are not limiting. Those of skill in the art will readily recognize a variety of non-critical parameters that can be changed or modified to yield essentially similar results.

Example 1: Examples of Embodiments

Provided hereafter are certain non-limiting examples of some embodiments of the technology.

A1. A nozzle capable of reversibly associating with a pipette tip chosen from pipette tips having sealing zones of substantially different diameters, and which nozzle is capable of connecting to a fluid delivery actuator component, the nozzle comprising:

- a substantially tubular exterior surface, a proximal terminus, a distal terminus, an interior bore terminating at each of the proximal terminus and the distal terminus, a distal region and a proximal region;
- which proximal region comprises a connector configured to sealingly connect the nozzle to a head of a fluid delivery actuator component;
- which distal region comprises a first pipette tip association member and a second pipette tip association member adjacent to, and distal to, the first pipette tip association member;
- which first pipette tip association member comprises a body, which body comprises an exterior surface and a first mean circumference, and a first annular pipette tip sealing zone protruding from the exterior surface of the body;
- which second pipette tip association member comprises a body, which body comprises an exterior surface and a second mean circumference, and a second annular pipette tip sealing zone protruding from the exterior surface of the body; and
- which first mean circumference is greater than the second mean circumference.

A1.1. The nozzle of embodiment A1, wherein a pipette tip that sealingly associates with the second pipette tip association member cannot sealingly associate with the first pipette tip association member.

A1.2. The nozzle of embodiment A1 or A1.1, wherein a pipette tip that sealingly associates with the first pipette tip association member cannot sealingly associate with the second pipette tip association member.

A2. The nozzle of any one of embodiments A1 to A1.2, wherein the first annular pipette tip sealing zone is not located at a boundary of the first pipette tip association member.

A3. The nozzle of embodiment A2, wherein the first annular pipette tip sealing zone is located at a position about equidistant from a distal boundary and a proximal boundary of the first pipette tip association member.

A4. The nozzle of embodiment A2 or A3, wherein the first pipette tip association member comprises an additional annular pipette tip sealing zone protruding from the exterior surface of the body and disposed at the distal boundary of the first pipette tip association member.

A5. The nozzle of any one of embodiments A1 to A4, wherein the second annular pipette tip sealing zone is not located at a boundary of the second pipette tip association member.

A6. The nozzle of embodiment A5, wherein the second annular pipette tip sealing zone is located at a position about equidistant from a distal boundary and a proximal boundary of the second pipette tip association member.

A7. The nozzle of embodiment A5 or A6, wherein the second pipette tip association member comprises an additional annular pipette tip sealing zone protruding from the exterior surface of the body and disposed at the distal boundary of the second pipette tip association member.

A8. The nozzle of any one of embodiments A1 to A7, wherein the exterior surface of the nozzle comprises a transition between the first pipette tip association member and the second pipette tip association member, which transition comprises a curved surface.

A9. The nozzle of any one of embodiments A1 to A8, wherein the first annular pipette tip sealing zone or the second annular pipette tip sealing zone, or the first annular pipette tip sealing zone and the second annular pipette tip sealing zone, comprises a curved surface.

A10. The nozzle of embodiment A9, wherein:

the curved surface of the sealing zone emanates from a first point on the exterior surface of the body and terminates at a second point on the exterior surface of the body, and the first point is proximal to the second point.

A11. The nozzle of any one of embodiments A7 to A10, wherein the additional annular member comprises a curved surface.

A11.1 The nozzle of embodiment A11, wherein the curved surface is defined by a compound curve.

A11.2. The nozzle of embodiment A11.1, wherein:

the compound curve comprises a first region of curvature defined by a first radius of curvature;

the compound curve comprises a second region of curvature defined by a second radius of curvature; and the first radius of curvature is different than the second radius of curvature.

A11.3. The nozzle of embodiment A11.2, wherein the first region of curvature is proximal to the second region of curvature and the first radius of curvature is greater than the second radius of curvature.

A12. The nozzle of any one of embodiments A1 to A11, wherein the exterior surface of the body of the first pipette tip association member substantially tapers from the proximal boundary to the distal boundary of the body.

A13. The nozzle of any one of embodiments A1 to A12, wherein the exterior surface of the body of the second pipette tip association member substantially tapers from the proximal boundary to the distal boundary of the body.

A14. The nozzle of any one of embodiments A1 to A13, which comprises a third pipette tip association member which comprises a body, which body comprises an exterior surface and a third mean circumference, and a third annular pipette tip sealing zone protruding from the exterior surface of the body, which third mean circumference is less than the second mean circumference.

A15. The nozzle of embodiment A14, wherein the third annular pipette tip sealing zone is not located at a boundary of the third pipette tip association member.

A16. The nozzle of embodiment A15, wherein the third annular pipette tip sealing zone is located at a position about equidistant from a distal boundary and a proximal boundary of the third pipette tip association member.

A17. The nozzle of embodiment A15 or A16, wherein the third pipette tip association member comprises an additional annular pipette tip sealing zone protruding from the exterior surface of the body and disposed at the distal boundary of the third pipette tip association member.

A18. The nozzle of any one of embodiments A14 to A17, wherein the exterior surface of the nozzle comprises a transition between the second pipette tip association member and the third pipette tip association member, which transition comprises a curved surface.

A18.1. The nozzle of embodiments A17 or A18, wherein the third pipette tip association member comprises a supplementary annular pipette tip sealing zone protruding from the exterior surface of the body and disposed near or at the proximal boundary of the third pipette tip association member.

A19. The nozzle of any one of embodiments A14 to A18.1, wherein the third annular pipette tip sealing zone or the supplementary annular pipette tip sealing zone, or the third annular pipette tip sealing zone and the supplementary annular pipette tip sealing zone, comprises a curved surface.

A20. The nozzle of embodiment A19, wherein:

the curved surface of the sealing zone emanates from a first point on the exterior surface of the body and terminates at a second point on the exterior surface of the body; and the first point is proximal to the second point.

A21. The nozzle of any one of embodiments A17 to A20, wherein the additional annular member comprises a curved surface.

A21.1 The nozzle of embodiment A21, wherein the curved surface is defined by a compound curve.

A21.2. The nozzle of embodiment A21.1, wherein:

the compound curve comprises a first region of curvature defined by a first radius of curvature;

the compound curve comprises a second region of curvature defined by a second radius of curvature; and the first radius of curvature is different than the second radius of curvature.

A21.3. The nozzle of embodiment A21.2, wherein the first region of curvature is proximal to the second region of curvature and the first radius of curvature is greater than the second radius of curvature.

A22. The nozzle of any one of embodiments A14 to A21, wherein the exterior surface of the body of the third pipette tip association member substantially tapers from the proximal boundary to the distal boundary of the body.

A23. The nozzle of any one of embodiments A1 to A22, wherein the bore comprises a cylindrical void.

A24. The nozzle of embodiment A23, wherein the interior surface of the bore comprises a substantially smooth surface.

A25. The nozzle of any one of embodiments A1 to A24, wherein the fluid delivery actuator component is a head member of a robotic fluid delivery device.

A26. The nozzle of any one of embodiments A1 to A25, wherein the connector is configured to reversibly engage with a connector counterpart of the fluid delivery actuator component.

A27. The nozzle of any one of embodiments A1 to A26, wherein the connector comprises a threaded member configured to sealingly engage a threaded member counterpart of the fluid delivery actuator component.

A28. The nozzle of any one of embodiments A1 to A27, wherein the connector comprises a tool engagement member.

A29. The nozzle of embodiment A28, wherein the tool engagement member is configured to engage a wrench.

A30. The nozzle of any one of embodiments A1 to A29, which comprises a metal.

A31. The nozzle of embodiment A30, which is manufactured from a metal.

A32. The nozzle of embodiment A30 or A31, wherein the metal is aluminum.

A33. The nozzle of embodiment A30 or A31, wherein the metal is a steel alloy.

B1. A head component capable of being fitted to a fluid delivery device, which head component comprises:

two opposing surfaces, sides between the opposing surfaces and a plurality of nozzles projecting from one of the opposing surfaces, each of which nozzles is capable of reversibly associating with a pipette tip chosen from pipette tips having sealing zones of substantially different diameters, and each of which nozzles comprises:

a substantially tubular exterior surface, a proximal terminus, a distal terminus, an interior bore terminating at each of the proximal terminus and the distal terminus, a distal region and a proximal region;

which distal region comprises a first pipette tip association member and a second pipette tip association member adjacent to, and distal to, the first pipette tip association surface;

which first pipette tip association member comprises a body, which body comprises an exterior surface and a first mean circumference, and a first annular pipette tip sealing zone protruding from a surface of the body;

which second pipette tip association member comprises a body, which body comprises an exterior surface and a second mean circumference, and a second annular pipette tip sealing zone protruding from a surface of the body; and which first mean circumference is greater than the second mean circumference.

B2. The head component of embodiment B1, wherein the exterior surface of each of the nozzles is integrated with the opposing surface from which the nozzles project.

B3. The head component of embodiment B1, wherein:

each of the nozzles and the head component are separate components, and the proximal region of each of the nozzles comprises a connector configured to sealingly connect the nozzle to the head component.

B4. The head component of any one of embodiments B1 to B3, comprising two or more bores, each of which bores terminates at each of the opposing surfaces, and each of which bores is configured to receive an ejection bar of a fluid delivery device.

C1. An ejection plate capable of ejecting pipette tips from nozzles of a fluid delivery device having ejection rods, which ejection plate comprises:

a plate member comprising two opposing plate member surfaces;

an array of bores, each of the bores terminating at each of the opposing plate member surfaces;

risers extending from one of the plate member surfaces;

a flange extending from each of the risers, which flange comprises two opposing flange surfaces substantially parallel to the plate member surfaces; and a connector in association with a flange surface, which connector is configured to effectively connect the ejection plate to an ejection rod of a fluid delivery device or which connector is configured to effectively connect the ejection plate to another ejection plate attached to a fluid delivery device.

C2. The ejection plate of embodiment C1, wherein the surface of each of the bores is not a vertical surface extending from one plate member surface to the other plate member surface.

C3. The ejection plate of embodiment C2, wherein the surface of each of the bores comprises a first surface member extending from, and is substantially vertical to, one of the plate member surfaces, and a second surface member extending from, and is substantially vertical to, the other plate member surface, which first surface member defines a cylindrical void having a diameter larger than the diameter of a cylindrical void defined by the second surface member.

C4. The ejection plate of embodiment C2, wherein the surface of each of the bores comprises a curved surface member.

C5. The ejection plate of embodiment C2, wherein the surface of each of the bores comprises an angled surface member, which angled surface member is disposed at an angle greater than about 90 degrees and less than about 180 degrees with respect to a plate member surface.

C6. The ejection plate of embodiment C4 or C5, wherein the surface of each of the bores comprises a surface member extending from, and substantially vertical to, one of the plate member surfaces.

C7. The ejection plate of any one of embodiments C2 to C6, wherein the surface of each of the bores is configured to fit around a sealing zone of a nozzle projecting from a head component of the fluid delivery device.

D1. An ejection plate capable of ejecting pipette tips from nozzles of a fluid delivery device having ejection rods, which ejection plate comprises:

a plate member comprising two opposing plate member surfaces;

an array of bores terminating at each of the opposing plate member surfaces, the surface of each of which bores is not a vertical surface extending from one plate member surface to the other plate member surface; and connectors each in association with a surface of the ejection plate, each of which connectors is configured to effectively connect the ejection plate to an ejection rod of a fluid delivery device or each of which connectors is configured to effectively connect the ejection plate to another ejection plate attached to a fluid delivery device.

D2. The ejection plate of embodiment D1, wherein the surface of each of the bores comprises a first surface member extending from, and is substantially vertical to, one of the plate member surfaces, and a second surface member extending from, and is substantially vertical to, the other plate member surface, which first surface member defines a cylindrical void having a diameter larger than the diameter of a cylindrical void defined by the second surface member.

D3. The ejection plate of embodiment D1, wherein the surface of each of the bores comprises a curved surface member.

D4. The ejection plate of embodiment D1, wherein the surface of each of the bores comprises an angled surface member, which angled surface member is disposed at an angle greater than about 90 degrees and less than about 180 degrees with respect to a plate member surface.

D5. The ejection plate of embodiment D3 or D4, wherein the surface of each of the bores comprises a surface member extending from, and substantially vertical to, one of the plate member surfaces.

D6. The ejection plate of any one of embodiments D1 to D5, wherein the surface of each of the bores is configured to fit around a sealing zone of a nozzle projecting from a head component of the fluid delivery device.

D7. The ejection plate of any one of embodiments D1 to D7, comprising:

risers extending from one of the opposing plate member surfaces; and a flange extending from each of the risers, which flange comprises two opposing flange surfaces substantially parallel to the plate member surfaces, each of which connectors is in association with a flange surface.

E1. The ejection plate of any one of embodiments C1 to C7 and D1 to D7, wherein each of the connectors in association with the ejection plate is configured for a magnetic connection.

E2. The ejection plate of embodiment E1, wherein the connector comprises a magnetizable material.

E3. The ejection plate of embodiment E1, wherein the connector comprises a magnetized material.

E4. The ejection plate of any one of embodiments C1 to C7, D1 to D7 and E1 to E3, wherein each of the connectors in association with the ejection plate is affixed to the ejection plate by an anchor or adhesive.

E5. The ejection plate of embodiment E4, wherein the anchor is a threaded anchor or rivet anchor.

E6. The ejection plate of any one of embodiments C1 to C7, D1 to D7 and E1 to E5, wherein each of which connectors in association with the ejection plate is configured to effectively connect the ejection plate to an ejection rod of the fluid delivery device.

E7. The ejection plate of embodiment E6, wherein the ejection rod comprises or is in association with a connector counterpart that connects to a corresponding connector on the ejection plate.

E8. The ejection plate of embodiment E7, wherein the connector counterpart is positioned inside the ejection rod.

E9. The ejection plate of embodiment E7, wherein the connector counterpart is part of a fastener configured to fasten to a fastener counterpart in the ejection rod.

E10. The ejection plate of embodiment E9, wherein the connector or fastener comprises a pin or bolt.

E11. The ejection plate of any one of embodiments E7 to E10, wherein the connector counterpart or the fastener counterpart, or the connector counterpart and the fastener counterpart, comprises a magnetic component.

E12. The ejection plate of embodiment E11, wherein the magnetic component is a magnetizable component.

E13. The ejection plate of embodiment E11, wherein the magnetic component is a magnetized component.

E14. The ejection plate of any one of embodiments C1 to C7, D1 to D7 and E1 to E5, wherein each of the connectors is configured to effectively connect an ejection plate to the another ejection plate attached to the fluid delivery device.

E15. The ejection plate of embodiment E14, wherein the first ejection plate is distal to the ejection plate in the fluid delivery device.

E16. The ejection plate of embodiment E14 or E15, wherein the ejection plate is connected directly to the first ejection plate.

E17. The ejection plate of embodiment E14 or E15, wherein the ejection plate is connected indirectly to the first ejection plate.

E18. The ejection plate of embodiment E17, wherein the ejection plate is fastened to the fluid delivery device by a connector, the ejection plate is connected to the fastener by a connection between a connector of the ejection plate and a connector counterpart of the fastener.

E19. The ejection plate of embodiment E18, wherein the connector or fastener comprises a pin or bolt.

E20. The ejection plate of embodiment E18 or E19, wherein the connector counterpart or the fastener counterpart, or the connector counterpart and the fastener counterpart, comprises a magnetic component.

E21. The ejection plate of embodiment E20, wherein the magnetic component is a magnetizable component.

E22. The ejection plate of embodiment E20, wherein the magnetic component is a magnetized component.

E23. The ejection plate of any one of embodiments E15 to E22, wherein terminus of the bores at the distal surface of a second ejection plate have a diameter greater than the diameter at the terminus of the bores at the distal surface of a first ejection plate.

E24. The ejection plate of any one of embodiments E14 to E23, wherein the ejection plate comprises a riser and the first ejection plate comprises no riser.

E25. The ejection plate of any one of embodiments C1 to C7, D1 to D7 and E1 to E24, wherein each of the connectors comprises a frustrum-shaped surface protruding from a surface of the ejection plate and is configured to connect to a frustrum-shaped void in a connector counterpart.

E26. The ejection plate of any one of embodiments C1 to C7, D1 to D7 and E1 to E25, wherein each of the connectors is a bushing.

E27. The ejection plate of any one of embodiments C1 to C7, D1 to D7 and E1 to E26, wherein each of the opposing plate member surfaces is substantially a quadrilateral comprising two opposing longer length sides and two opposing shorter length sides.

E28. The ejection plate of embodiment E27, wherein:

each riser comprises a longer length side and a shorter length side, and the longer length side of each riser is coextensive with a shorter length side of a plate member surface.

E29. The ejection plate of any one of embodiments C1 to C7, D1 to D7 and E1 to E28, wherein the thickness of each flange is substantially the same as the thickness of the plate member.

E30. The ejection plate of any one of embodiments C1 to C7, D7 and E1 to E29, wherein the thickness of each riser is substantially the same as the thickness of the plate member.

F1. A composition comprising a first ejection plate and a second ejection plate each capable of ejecting pipette tips from nozzles of a fluid delivery device having ejection rods, which first ejection plate and which second ejection plate each comprise:

a plate member comprising two opposing plate member surfaces;

an array of bores, each of which bores terminates at each of the opposing plate member surfaces; and connectors each in association with a surface of each of the second ejection plate and the first ejection plate;

wherein the connectors of the first ejection plate and the connectors of the second ejection plate are configured for:

mounting the first ejection plate and the second ejection plate in a fluid delivery device whereby the plate member surfaces of the second ejection plate are distal to the plate member surfaces of the first ejection plate;

mounting the first ejection plate and the second ejection plate in an orientation that positions the bores of the second ejection plate concentric with the bores of the first ejection plate.

F1.1. The composition of embodiment F1, wherein the second ejection plate or the first ejection plate, but not the second ejection plate and the first ejection plate, is mounted in the fluid delivery device.

F1.2. The composition of embodiment F1, wherein the second ejection plate and the first ejection plate are mounted in the fluid delivery device.

F2. The composition of embodiment F1, wherein the connectors or the second ejection plate or the connectors of the first ejection plate, or the connectors or the second ejection plate and the connectors of the first ejection plate, are configured for a magnetic connection.

F3. The composition of embodiment F1 or F2, wherein the terminus of the bores at the distal plate member surface of the second ejection plate have a diameter less than the diameter at the terminus of the bores at the distal plate member surface of the first ejection plate.

F4. The composition of any one of embodiments F1 to F3, wherein the second ejection plate comprises:

risers extending from one of the opposing plate member surfaces; and a flange extending from each of the risers, which flange comprises two opposing flange surfaces substantially parallel to the plate member surfaces, each of which connectors of the second ejection plate is in association with a flange surface.

F5. The composition of embodiment F4, wherein the connectors of the second ejection plate are directly connected to a surface, or to connectors, of the first ejection plate.

F6. The composition of any one of embodiments F1 to F5, wherein each of the connectors comprises a frustrum-shaped surface protruding from a surface of the ejection plate and is configured to connect to a frustrum-shaped void in a connector counterpart.

F7. The composition of any one of embodiments F1 to F6, wherein each of the connectors is a bushing.

F8. The composition of any one of embodiments F1 to F7, wherein the surface of each of the bores in the second ejection plate or the first ejection plate, or the second ejection plate and the first ejection plate, is not a vertical surface extending from one plate member surface to the other plate member surface.

F9. The composition of any one of embodiments F1 to F8, wherein each of the connectors of the second ejection plate is configured for mounting the second ejection plate to the fluid delivery device by a fastener.

F10. The composition of embodiment F9, wherein the fastener comprises a connector counterpart configured to connect to a connector of the first ejection plate.

F11. The composition of embodiment F10, wherein the connector counterpart in the fastener and the connector of the first ejection plate are configured for a magnetic connection.

F12. The composition of any one of embodiments F1 to F11, wherein the second ejection plate or the first ejection plate, or the second ejection plate and the first ejection plate, are constructed from a substantially non-magnetizable material.

F13. The composition of embodiment F12, wherein the connectors of the second ejection plate or the first ejection plate, or the second ejection plate and the first ejection plate, are configured for a magnetic connection.

F14. The composition of any one of embodiments F1 to F11, wherein the second ejection plate or the first ejection plate, or the second ejection plate and the first ejection plate, are constructed from a substantially magnetizable material.

G1. A method for ejecting one or more pipette tips from an automated fluid delivery device comprising:

(a) Sealingly connecting pipette tips to nozzles of a head component of a fluid delivery device which nozzles are substantially the same and each of which nozzles is capable of reversibly associating with a pipette tip, which one or more pipette tips are chosen from pipette tips having sealing zones of substantially different diameters; and (b) ejecting the pipette tips from the nozzles via actuation of an ejector effectively magnetically attached to the fluid delivery device, which ejector plate contacts the pipette tips and displaces the pipette tips from the nozzle.

G2. The method of embodiment G1 comprising attaching the ejector plate to the head component of a fluid delivery device, wherein the ejector plated is magnetically mounted to the head component.

The entirety of each patent, patent application, publication and document referenced herein hereby is incorporated by reference. Citation of the above patents, patent applications, publications and documents is not an admission that any of the foregoing is pertinent prior art, nor does it constitute any admission as to the contents or date of these publications or documents.

Modifications may be made to the foregoing without departing from the basic aspects of the technology. Although the technology has been described in substantial detail with reference to one or more specific embodiments, those of ordinary skill in the art will recognize that changes may be made to the embodiments specifically disclosed in this application, yet these modifications and improvements are within the scope and spirit of the technology.

The technology illustratively described herein suitably may be practiced in the absence of any element(s) not specifically disclosed herein. Thus, for example, in each instance herein any of the terms "comprising," "consisting essentially of," and "consisting of" may be replaced with either of the other two terms. The terms and expressions which have been employed are used as terms of description and not of limitation, and use of such terms and expressions do not exclude any equivalents of the features shown and described or portions thereof, and various modifications are possible within the scope of the technology claimed. The term "a" or "an" can refer to one of or a plurality of the elements it modifies (e.g., "a reagent" can mean one or more reagents) unless it is contextually clear either one of the elements or more than one of the elements is described. The term "about" as used herein refers to a value within 10% of the underlying parameter (i.e., plus or minus 10%), and use of the term "about" at the beginning of a string of values modifies each of the values (i.e., "about 1, 2 and 3" refers to about 1, about 2 and about 3). For example, a weight of "about 100 grams" can include weights between 90 grams and 110 grams. Further, when a listing of values is described herein (e.g., about 50%, 60%, 70%, 80%, 85% or 86%) the listing includes all intermediate and fractional values thereof (e.g., 54%, 85.4%). Thus, it should be understood that although the present technology has been specifically disclosed by representative embodiments and optional features, modification and variation of the concepts herein disclosed may be resorted to by those skilled in the art, and such modifications and variations are considered within the scope of this technology.

Certain embodiments of the technology are set forth in the claim(s) that follow(s).

What is claimed is:

1. A fluid delivery actuator component comprising a housing, one or more ejector bars, and an array of nozzles, wherein at least one of the nozzles of the array of nozzles is configured to associate with pipette tips having sealing zones of substantially different diameters, the nozzle comprising:

a substantially tubular exterior surface, a proximal terminus, a distal terminus, an interior bore terminating at each of the proximal terminus and the distal terminus, a distal region and a proximal region;

which proximal region comprises a connector configured to sealingly connect the nozzle to a head of a fluid delivery actuator component;

which distal region comprises a first pipette tip association member and a second pipette tip association member adjacent to, and distal to, the first pipette tip association member;

which first pipette tip association member comprises a first body, which first body comprises an exterior surface and a first annular pipette tip sealing zone protruding from the exterior surface of the first body, which first annular pipette tip sealing zone comprises a curved surface with a first profile along a longitudinal axis extending from the proximal terminus to the distal terminus of the nozzle, defined by a first radius of curvature configured for sealing association with the sealing zone of a pipette tip, and a first mean circumference;

which second pipette tip association member comprises a second body, which second body comprises an exterior surface and a second annular pipette tip sealing zone protruding from the exterior surface of the second body, which second annular pipette tip sealing zone comprises a curved surface with a second profile along the longitudinal axis, defined by a second radius of curvature configured for sealing association with the sealing zone of a pipette tip, and a second mean circumference;

which first annular pipette tip sealing zone is not located at a boundary of the first pipette tip association member and which first pipette tip association member comprises an additional annular pipette tip sealing zone protruding from the exterior surface of the body and disposed at the distal boundary of the first pipette tip association member and/or which second annular pipette tip sealing zone is not located at a boundary of the second pipette tip association member and which second pipette tip association member comprises an additional annular pipette tip sealing zone protruding from the exterior surface of the body and disposed at the distal boundary of the second pipette tip association member;

which first mean circumference is greater than the second mean circumference; and which pipette tip association members and annular pipette tip sealing zones comprise the same material.

2. The fluid delivery actuator component of claim 1, comprising a pipette tip that sealingly associates with:

the first annular pipette tip sealing zone, but does not sealingly associate with the second annular pipette tip sealing zone; or the second annular pipette tip sealing zone, but does not sealingly associate with the first annular pipette tip sealing zone.

3. The fluid delivery actuator component of claim 1, wherein the connector comprises a tool engagement member.

4. The fluid delivery actuator component of claim 1, comprising an ejector plate.

5. The fluid delivery actuator component of claim 1, wherein the material comprises a metal.

6. A fluid delivery actuator component comprising a housing, one or more ejector bars, and an array of nozzles, wherein at least one of the nozzles of the array of nozzles is configured to associate with pipette tips having sealing zones of substantially different diameters, the nozzle comprising:

a substantially tubular exterior surface, a proximal terminus, a distal terminus, an interior bore terminating at each of the proximal terminus and the distal terminus, a distal region and a proximal region;

which proximal region comprises a connector configured to sealingly connect the nozzle to a head of a fluid delivery actuator component;

which distal region comprises a first pipette tip association member and a second pipette tip association member adjacent to, and distal to, the first pipette tip association member and a third pipette tip association member adjacent to, and distal to, the second pipette tip association member;

which first pipette tip association member comprises a first body, which first body comprises an exterior surface and a first annular pipette tip sealing zone protruding from the exterior surface of the first body, which first annular pipette tip sealing zone comprises a curved surface with a first profile along a longitudinal axis extending from the proximal terminus to the distal terminus of the nozzle, defined by a first radius of curvature configured for sealing association with the sealing zone of a pipette tip, and a first mean circumference;

which second pipette tip association member comprises a second body, which second body comprises an exterior surface and a second annular pipette tip sealing zone protruding from the exterior surface of the second body, which second annular pipette tip sealing zone comprises a curved surface with a second profile along the longitudinal axis, defined by a second radius of curvature configured for sealing association with the sealing zone of a pipette tip, and a second mean circumference;

which third pipette tip association member which comprises a third body, which third body comprises an exterior surface and a third annular pipette tip sealing zone protruding from the exterior surface of the third body, which third annular pipette tip sealing zone comprises a curved surface with a third profile along the longitudinal axis, defined by a third radius of curvature configured for sealing association with the sealing zone of a pipette tip, and a third mean circumference;

which first mean circumference is greater than the second mean circumference;

which third mean circumference is less than the second mean circumference; and which pipette tip association members and annular pipette tip sealing zones comprise the same material.

7. The fluid delivery actuator component of claim 6, comprising a pipette tip that sealingly associates with:

the first annular pipette tip sealing zone, but does not sealingly associate with the second annular pipette tip sealing zone or the third annular pipette tip sealing zone, the second annular pipette tip sealing zone, but does not sealingly associate with the first annular pipette tip sealing zone or the third annular pipette tip sealing zone, or the third annular pipette tip sealing zone, but does not sealingly associate with the first annular pipette tip sealing zone or the second annular pipette tip sealing zone.

8. The fluid delivery actuator component of claim 6, wherein the third annular pipette tip sealing zone is not located at a boundary of the third pipette tip association member.

9. The fluid delivery actuator component of claim 6, wherein the connector comprises a tool engagement member.

10. The fluid delivery actuator component of claim 6, comprising an ejector plate.

11. The fluid delivery actuator component of claim 6, wherein the material comprises a metal.

12. A nozzle capable of reversibly associating with pipette tips having sealing zones of substantially different diameters, and which nozzle is capable of connecting to a fluid delivery actuator component, the nozzle comprising:

a substantially tubular exterior surface, a proximal terminus, a distal terminus, an interior bore terminating at each of the proximal terminus and the distal terminus, a distal region and a proximal region;

which proximal region comprises a connector configured to sealingly connect the nozzle to a head of a fluid delivery actuator component;

which distal region comprises a first pipette tip association member and a second pipette tip association member adjacent to, and distal to, the first pipette tip association member;

which first pipette tip association member comprises a first body, which first body comprises an exterior surface and a first annular pipette tip sealing zone protruding from the exterior surface of the first body, which first annular pipette tip sealing zone comprises a curved surface with a first profile along a longitudinal axis extending from the proximal terminus to the distal terminus of the nozzle, defined by a first radius of curvature configured for sealing association with the sealing zone of a pipette tip, and a first mean circumference;

which second pipette tip association member comprises a second body, which second body comprises an exterior surface and a second annular pipette tip sealing zone protruding from the exterior surface of the second body, which second annular pipette tip sealing zone comprises a curved surface with a second profile along the longitudinal axis, defined by a second radius of curvature configured for sealing association with the sealing zone of a pipette tip, and a second mean circumference;

which first annular pipette tip sealing zone is not located at a boundary of the first pipette tip association member and which first pipette tip association member comprises an additional annular pipette tip sealing zone protruding from the exterior surface of the body and disposed at the distal boundary of the first pipette tip association member and/or which second annular pipette tip sealing zone is not located at a boundary of the second pipette tip association member and which second pipette tip association member comprises an additional annular pipette tip sealing zone protruding from the exterior surface of the body and disposed at the distal boundary of the second pipette tip association member;

which first mean circumference is greater than the second mean circumference; and which pipette tip association members and annular pipette tip sealing zones comprise the same material.

13. The nozzle of claim 12, comprising a pipette tip that sealingly associates with:

the first annular pipette tip sealing zone, but does not sealingly associate with the second annular pipette tip sealing zone; or the second annular pipette tip sealing zone, but does not sealingly associate with the first annular pipette tip sealing zone.

14. The nozzle of claim 12, wherein the material comprises a metal.

15. A nozzle capable of reversibly associating with pipette tips having sealing zones of substantially different diameters, and which nozzle is capable of connecting to a fluid delivery actuator component, the nozzle comprising:

a substantially tubular exterior surface, a proximal terminus, a distal terminus, an interior bore terminating at each of the proximal terminus and the distal terminus, a distal region and a proximal region;

which proximal region comprises a connector configured to sealingly connect the nozzle to a head of a fluid delivery actuator component;

which distal region comprises a first pipette tip association member and a second pipette tip association member adjacent to, and distal to, the first pipette tip association member and a third pipette tip association member adjacent to, and distal to, the second pipette tip association member;

which first pipette tip association member comprises a first body, which first body comprises an exterior surface and a first annular pipette tip sealing zone protruding from the exterior surface of the first body, which first annular pipette tip sealing zone comprises a curved surface with a first profile along a longitudinal axis extending from the proximal terminus to the distal terminus of the nozzle, defined by a first radius of curvature configured for sealing association with the sealing zone of a pipette tip, and a first mean circumference;

which second pipette tip association member comprises a second body, which second body comprises an exterior surface and a second annular pipette tip sealing zone protruding from the exterior surface of the second body, which second annular pipette tip sealing zone comprises a curved surface with a second profile along the longitudinal axis, defined by a second radius of curvature configured for sealing association with the sealing zone of a pipette tip, and a second mean circumference;

which third pipette tip association member which comprises a third body, which third body comprises an exterior surface and a third annular pipette tip sealing zone protruding from the exterior surface of the third body, which third annular pipette tip sealing zone comprises a curved surface with a third profile along the longitudinal axis, defined by a third radius of curvature configured for sealing association with the sealing zone of a pipette tip, and a third mean circumference;

which first mean circumference is greater than the second mean circumference;

which third mean circumference is less than the second mean circumference; and which pipette tip association members and annular pipette tip sealing zones comprise the same material.

16. The nozzle of claim 15, comprising a pipette tip that sealingly associates with:

the first annular pipette tip sealing zone, but does not sealingly associate with the second annular pipette tip sealing zone or the third annular pipette tip sealing zone, the second annular pipette tip sealing zone, but does not sealingly associate with the first annular pipette tip sealing zone or the third annular pipette tip sealing zone, or the third annular pipette tip sealing zone, but does not sealingly associate with the first annular pipette tip sealing zone or the second annular pipette tip sealing zone.

17. The nozzle of claim 15, wherein the third annular pipette tip sealing zone is not located at a boundary of the third pipette tip association member.

18. The nozzle of claim 15, wherein the material comprises a metal.

* * * * *